US008457516B2

(12) United States Patent
Fujiwara

(10) Patent No.: US 8,457,516 B2
(45) Date of Patent: Jun. 4, 2013

(54) IMAGE FORMING APPARATUS AND METHOD USING AN ENVIRONMENT DETECTOR WHICH CHANGES A TEST TONER IMAGE BASED ON A DETECTION RESULT

(75) Inventor: Yoshihiro Fujiwara, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/367,902

(22) Filed: Feb. 7, 2012

(65) Prior Publication Data

US 2012/0134702 A1 May 31, 2012

Related U.S. Application Data

(62) Division of application No. 12/125,647, filed on May 22, 2008, now abandoned.

(30) Foreign Application Priority Data

May 22, 2007 (JP) ..... 2007-135498

(51) Int. Cl.
*G03G 15/00* (2006.01)

(52) U.S. Cl.
USPC ..... 399/72; 358/1.18; 358/450

(58) Field of Classification Search
USPC ..... 399/44, 72; 358/1.18
See application file for complete search history.

(56) References Cited

U.S. PATENT DOCUMENTS

| | | | | |
|---|---|---|---|---|
| 4,684,243 | A | 8/1987 | Minor | |
| 4,809,039 | A | 2/1989 | Ishii | |
| 6,226,419 | B1 | 5/2001 | Lodwick et al. | |
| 6,302,510 | B1 | 10/2001 | Yoshida | |
| 6,687,471 | B2 | 2/2004 | Sakata et al. | |
| 8,045,871 | B2 | 10/2011 | Monma et al. | |
| 8,103,180 | B2 * | 1/2012 | Yuasa | 399/45 |
| 8,224,208 | B2 * | 7/2012 | Shimba | 399/227 |
| 2003/0044193 | A1 | 3/2003 | Thomas et al. | |
| 2006/0152775 | A1 * | 7/2006 | Itoyama et al. | 358/504 |
| 2006/0233561 | A1 | 10/2006 | Yamaoka | |
| 2006/0285863 | A1 | 12/2006 | Noguchi et al. | |
| 2007/0053727 | A1 | 3/2007 | Goto | |
| 2007/0133056 | A1 | 6/2007 | Noguchi et al. | |
| 2008/0089706 | A1 * | 4/2008 | Nakazato et al. | 399/44 |
| 2009/0154944 | A1 * | 6/2009 | Kawaguchi | 399/49 |
| 2010/0247121 | A1 * | 9/2010 | Shimba | 399/43 |
| 2012/0308246 | A1 * | 12/2012 | Okamoto | 399/49 |

FOREIGN PATENT DOCUMENTS

| | | |
|---|---|---|
| JP | 10-31375 | 2/1998 |
| JP | 2001-209270 | 8/2001 |
| JP | 2004-354624 | 12/2004 |

OTHER PUBLICATIONS

Office Action issued Nov. 18, 2011, in Japanese Patent Application No. 2007-135498.

* cited by examiner

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

An image forming apparatus includes an image carrier, an image forming member, a transferer, a toner image detector, and a controller. The transferer transfers the toner image from the image carrier directly or indirectly onto a recording medium transported by a surface moving member. The toner image detector detects a test toner image formed in a test toner image detection area located at an end portion of the surface moving member. The controller checks a length of the recording medium in a main scanning direction during continuous image formation, and forms the test toner image either in a space between recording media when the length of the recording medium exceeds a length of the surface moving member minus a length of the test toner image detection area in the main scanning direction or otherwise in parallel to the toner image transferred onto the recording medium.

13 Claims, 15 Drawing Sheets

IMAGE FORMING APPARATUS AND METHOD USING AN ENVIRONMENT DETECTOR WHICH CHANGES A TEST TONER IMAGE BASED ON A DETECTION RESULT

CROSS-REFERENCE TO RELATED APPLICATIONS

This application is a division of and claims the benefit of priority under 35 U.S.C. §120 from U.S. application Ser. No. 12/125,647, filed May 22, 2008 now abandoned, and claims the benefit of priority under 35 U.S.C. §119 from Japanese Patent Application No. 2007-135498, filed on May 22, 2007, in the Japan Patent Office, the entire contents of each of which are hereby incorporated by reference herein.

BACKGROUND OF THE INVENTION

1. Field of the Invention

The present invention generally relates to an image forming apparatus such as a copier, a printer, a facsimile machine, and a multifunction machine including at least two of these functions.

2. Discussion of the Background Art

In general, an electrophotographic image forming apparatus such as a copier, a printer, a facsimile machine, etc., includes an image carrier on which an electrostatic latent image is formed, a developing unit to develop the electrostatic latent image with a developer, and a transferer to transfer the developed image onto a recording medium such as transfer sheets. Such an image forming apparatus further includes a surface moving member, such as a sheet transfer belt and an intermediate transfer belt, whose surface moves endlessly.

Known full color image forming apparatuses include a plurality of image carriers on each of which a different color toner image is formed. The respective toner images on the image carriers are then transferred and superimposed one on another directly on the recording medium that is transported by the sheet transfer belt, in what is known as a direct transfer method, or primarily on the intermediate transfer belt and then transferred secondarily onto the recording medium, in what is known as an intermediate transfer method.

Such image forming apparatuses are typically provided with functions to adjust image density, color deviation, and image position. In a known method, a test pattern of toner images is formed on a detection area provided at an end portion of such a surface moving member and detected by an optical sensor, and image density and/or registration of colors are adjusted according to results of the detection.

One known image forming apparatus forms the test pattern in a space between sheets on the surface moving member while images are successively being formed on multiple sheets. However, such as approach requires a relatively long interval between sheets so as to have an area for the test pattern between sheets, which reduce image formation continuous productivity.

In another known image forming apparatus, each of the image carrier, a developing roller, a transfer roller, etc., has an axial length greater than a maximum width of sheets usable therein, and thus an area over which sheets do not pass (non-sheet area) is available on the surface moving member. The image forming apparatus forms test patterns on the non-sheet areas of the surface moving member, and the optical sensor detects the test patterns.

When the non-sheet areas are provided on the surface moving member, the test patterns can be formed parallel to images to be transferred onto the sheets in a main scanning direction, and thus the interval between sheets is relatively short. However, when the non-sheet areas are provided, the lengths of the image carrier, the developing roller, the transfer roller, etc., are increased in the axial direction, and thus the image forming apparatus becomes larger and its cost is increased.

SUMMARY OF THE INVENTION

In view of the foregoing, in one illustrative embodiment of the present invention, an image forming apparatus includes an image carrier, an image forming member configured to form a toner image on the image carrier, a transferer, a toner image detector, and a controller. The transferer transfers the toner image from the image carrier directly onto a recording medium transported by a surface moving member or onto the recording medium after transferring the toner image onto a surface of the surface moving member. The toner image detector is located adjacent to the surface moving member and detects a test toner image formed in a test toner image detection area located at an end portion of the surface moving member. The controller checks a length of the recording medium in a main scanning direction during continuous image formation to form images on multiple recording media successively and the image forming member to form the test toner image. When the length of the recording medium in the main scanning direction is longer than a value obtained by deducting a length of the test toner image detection area from a length of the surface moving member in the main scanning direction, the test toner image is formed in a space between the recording media in the test toner image detection area. When the length of the recording medium in the main scanning direction is shorter than the value obtained by deducting the length of the test toner image detection area from the length of the surface moving member in the main scanning direction, the test toner image is formed parallel to the toner image transferred onto the recording medium.

In another illustrative embodiment, a test toner image forming method used in the image forming apparatus described above includes checking a length of the recording medium in a main scanning direction during continuous image formation to form images on multiple recording media successively, forming the test toner image in the test toner image detection area. When the length of the recording medium in the main scanning direction is longer than a value obtained by deducting a length of the test toner image detection area from a length of the surface moving member in the main scanning direction, the test toner image is formed in a space between the recording media. When the length of the recording medium in the main scanning direction is shorter than the value obtained by deducting the length of the test toner image detection area from the length of the surface moving member in the main scanning direction, the test toner image is formed parallel to the toner image transferred onto the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
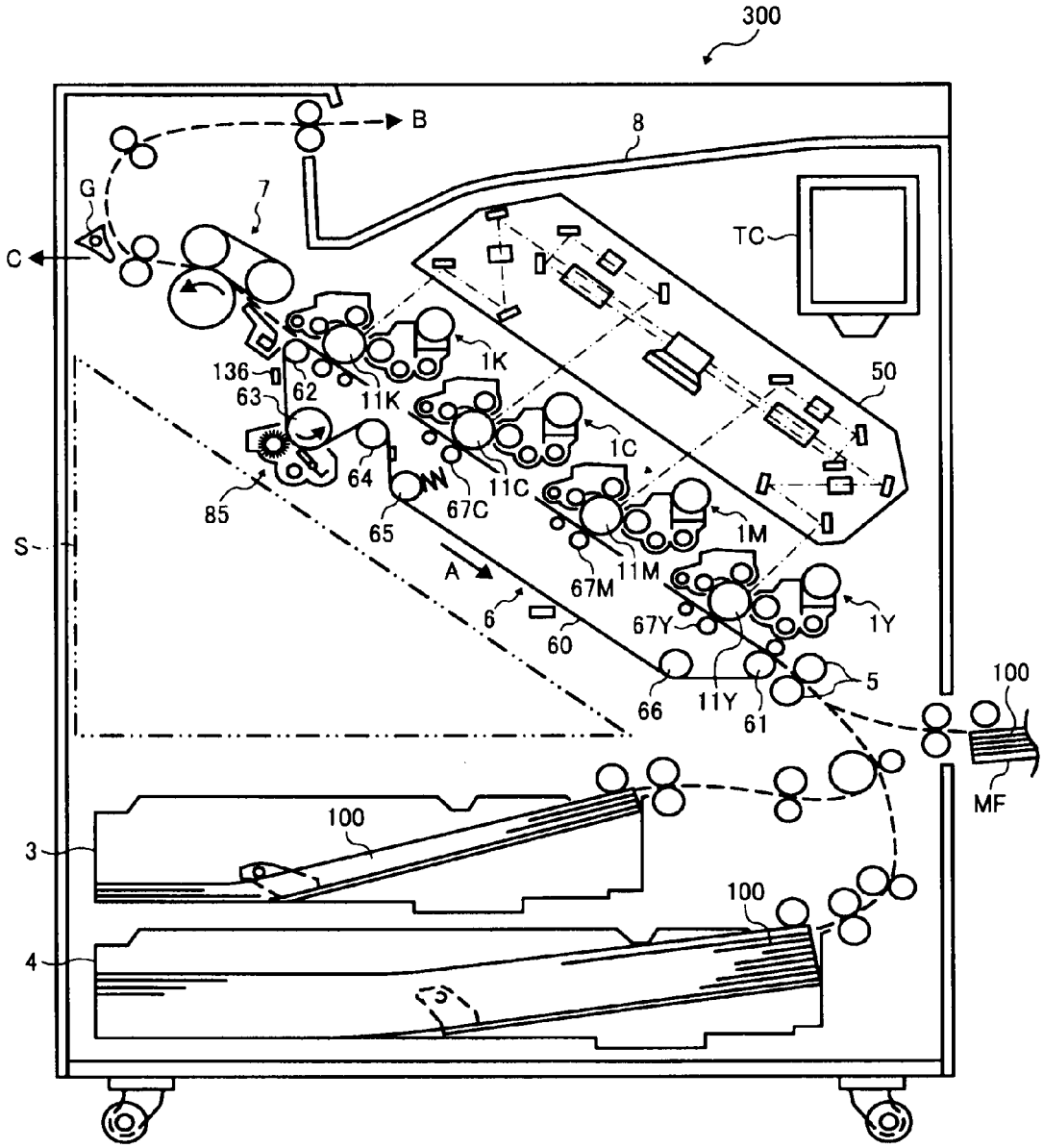
FIG. 1 illustrates a schematic configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an electronographic image forming apparatus 300 according to an illustrative embodiment of the present invention is described.

FIG. 1 is a schematic illustration of the image forming apparatus 300 such as a laser printer.

The image forming apparatus 300 includes four process units 1Y, 1M, 1C, and 1K for forming yellow, magenta, cyan, and black images, respectively. Reference characters Y, M, C, and K show yellow, magenta, cyan, and black, respectively, and may be omitted when color discrimination is not necessary. In FIG. 1, a chain one-dashed line indicates a sheet feed path along which a transfer sheet 100 is transported.

The process units 1Y, 1M, 1C, and 1K include photoreceptors 11Y, 11M, 11C, and 11K, respectively. The process units 1Y, 1M, 1C, and 1K are arranged at a predetermined or given space in order from an upstream side in a transfer direction of the transfer sheet 100 (sheet transfer direction), and rotation axes of the photoreceptors 11Y, 11M, 11C, and 11K are parallel to each other in the sheet transfer direction.

The image forming apparatus 300 further includes an optical writing unit 50 located above the process units 1Y, 1M, 1C, and 1K in FIG. 1, sheet cassettes 3 and 4 located at a bottom part thereof, a pair of registration rollers 5, a transfer unit 6, a belt type fixer 7, and a discharge tray 8. The image forming apparatus 300 further includes a manual feed tray MF, a toner supply container TC, and a space S. Although not shown, a waste toner bottle, a reverse unit, and power supply unit are provided in the space S. Arrows B and C indicate a first discharge direction and a second discharge direction, respectively.

The transfer unit 6 serves as a transferer and includes a transport belt 60 that is a surface moving member and looped around an entrance roller 61, a driving roller 63, a tension roller 65, an exit roller 62, and support rollers 64 and 66. The transport belt 60 transports the transfer sheet 100 in a direction of movement indicated by arrow A so that the transfer sheet 100 passes transfer positions of the process units 1Y, 1M, 1C, and 1K where the photoreceptors 11Y, 11M, 11C, and 11K face the transport belt 60 and the toner images are transferred from the photoreceptors 11Y, 11M, 11C, and 11K onto the transfer sheet 100.

The transfer unit 6 further includes transfer bias applicator 67Y, 67M, 67C, and 67K located at the transfer positions of the process units 1Y, 1M, 1C, and 1K, respectively, so as to contact a back surface of the transport belt 60.

A cleaning unit 85 including a brush roller and a cleaning blade is provided to contact a part of an outer surface of the transport belt 60 that is wound around the driving roller 63. The cleaning unit 85 serves as a cleaner and removes toner, etc., adhered to the transport belt 60.

The image forming apparatus 300 further includes a switch guide G, and an optical sensor unit 136 that serves as toner image detector and located in an adjacent portion to the transport belt 60.

Figure 2:
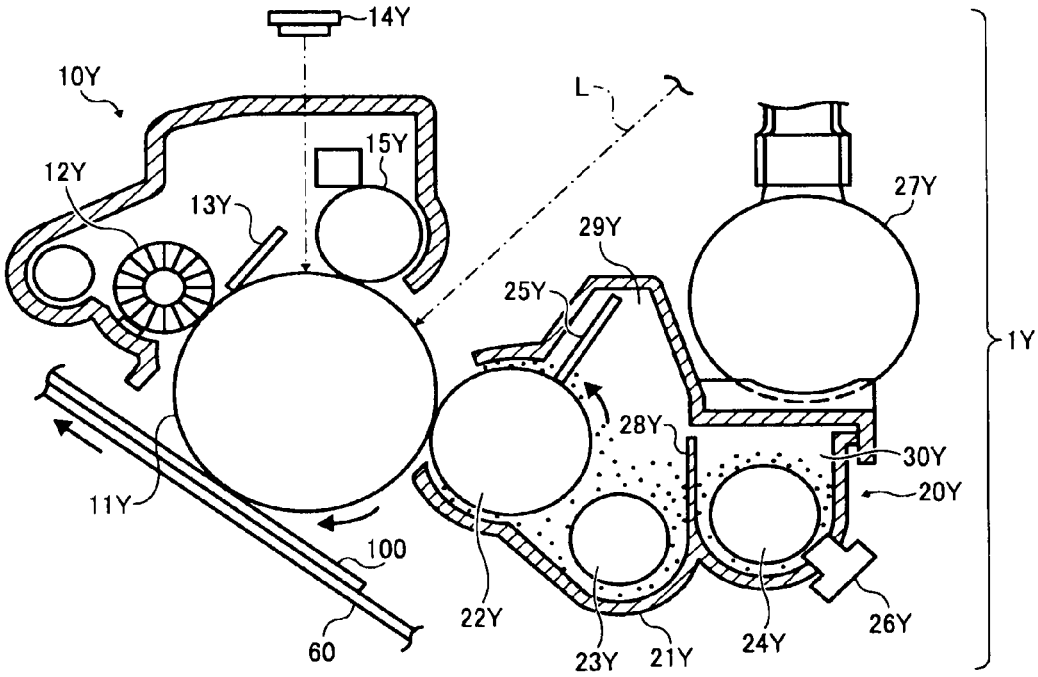
FIG. 2 illustrates a schematic configuration of a process unit included in the image forming apparatus shown in FIG. 1.

FIG. 2 schematically illustrates a configuration of the yellow process unit 1Y. It is to be noted that the process units 1M, 1C, and 1K have a configuration similar to that of the process unit 1Y, and thus descriptions thereof omitted.

As shown in FIG. 2, the process unit 1Y includes a photoreceptor unit 10Y including the photoreceptor 11Y, and the developing unit 20Y. The photoreceptor unit 10Y further includes a brush roller 12Y for applying lubricator to a surface of the photoreceptor 11Y, a counter blade 13Y that is able to pivot and cleans the surface of the photoreceptor 11Y, a discharge lamp 14Y for removing electrical charges from the photoreceptor 11Y, and a non-contact charging roller 15Y for charging the surface of the photoreceptor 11Y uniformly. In the present embodiment, the photoreceptor 11Y includes an organic photo conductor (OPC) layer on its surface.

After the charging roller 15Y uniformly charges the surface of the photoreceptor 11Y with AC (alternating current) voltage, the optical writing unit 50 shown in FIG. 1 directs a modulated and deflected laser light L thereonto, and thus an electrostatic latent image is formed thereon.

As illustrated in FIG. 2, the developing unit 20Y includes a developing roller 22Y that is partly exposed from an opening of a developing case 21Y, a first part 29Y provided with a first screw 23Y, a second part 30Y provided with a second screw 24Y, a doctor blade 25Y, a toner concentration sensor 26Y, and a powder pump 27Y connecting to a toner cartridge containing yellow toner.

The developing case 21 contains a two-component developer including a magnetic carrier and a yellow toner that is negatively charged. After the first screw 23Y and the second screw 24Y agitate and transport the developer so as to charge the developer frictionally, the developer is drawn up to a surface of the developing roller 22Y serving as a developer carrier, forming a developer layer thereon. The doctor blade 25Y regulates a thickness of the developer layer, and then the developer on the developing roller 22Y is transported to a development area in which the developing roller 22Y faces the photoreceptor 11Y. In the development area, the toner in the developer adheres to the electrostatic latent image, developing the electrostatic latent image into a yellow toner image. After the yellow toner is thus consumed in the development, the developer is returned to the developing case 21Y as the developing roller 22Y rotates.

Between the first screw 23Y and the second screw 24Y, a partition 28Y is provided so as to separate the first part 29Y and the second part 30Y in the developing case 21Y.

The yellow toner image formed on the photoreceptor 11Y is transferred onto the transfer sheet 100 transported by the transport belt 60.

The first screw 23Y is rotated by a driving member, not shown, and feeds the developer to the developing roller 22Y while transporting the developer through the first portion 29Y in a direction from the front side to the back side of the sheet on which FIG. 2 is drawn, along the surface of the developing roller 22Y.

The partition 28Y is provided with two communication ports for transporting the developer between the first part 29Y and the second part 30Y at both end portions of the first screw 23Y and the second screw 24Y.

When the developer is transported by the first screw 23Y to a downstream end portion of the first portion 29Y in a developer circulation direction, the developer moves to the second portion 30Y through one of the communication ports, not shown.

The second screw 24Y in the second portion 30Y is rotated by a driving member, not shown, and transports the developer in a direction opposite the direction in which the first screw 23Y transports the developer. When the developer is transported by the second screw 23Y to a downstream end portion of the second portion 30Y in a developer circulation direction, the developer returns to the first portion 29Y through the other communication port, not shown, provided on the partition 28Y.

The toner concentration sensor 26Y is a magnetic permeability sensor, for example, and is located in a center portion of a bottom wall of the second part 30Y.

Figure 3:
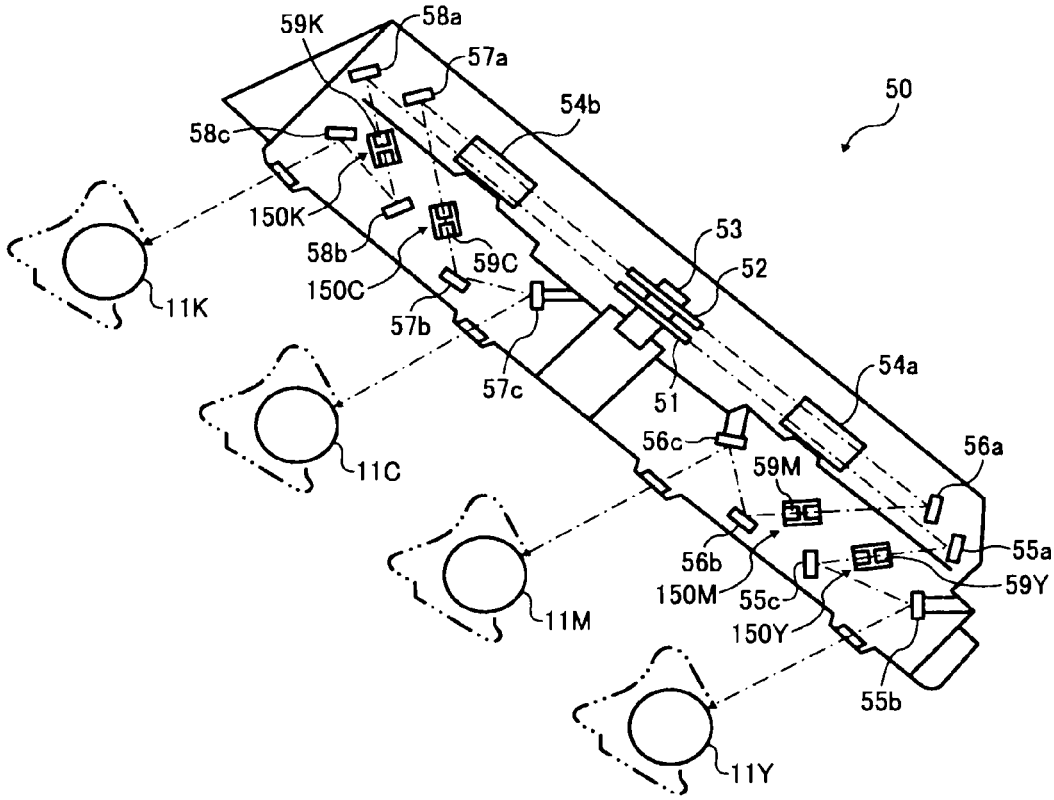
FIG. 3 is an enlarged illustration of an optical writing unit included in the image forming apparatus shown in FIG. 1.

FIG. 3 is an enlarged illustration of the optical writing unit 50 in which the photoreceptors 11Y, 11M, 11C, and 11K are also shown.

The optical writing unit 50 includes rotary polygon mirrors 51 and 52 that are rotated by a polygon motor 53, long lens units 150Y, 150M, 150C, and 150K, and two laser light sources, not shown, that in the present embodiment are laser diodes. The long lens units 150Y, 150M, 150C, and 150K include long lens 59Y, 59M, 59C, and 59K, respectively. Laser lights for yellow, magenta, cyan, and black emitted from the laser light sources are modulated according to image information and reflected by the rotary polygon mirrors 51 and 52. The laser lights for yellow and magenta pass through a double-layered f-theta lens 54*a* after being reflected by the rotary polygon mirrors 51 and 52.

The laser light for yellow is then reflected by the first mirror 55*a* to the long lens 59Y, and thus optical face tangle error of the polygon mirrors 51 and 52 is corrected. Optical face tangle error occurs when a reflection surface of a polygon mirror is oblique to a sub-scanning direction due to construction error, etc., and makes scanning pitch uneven. The laser light for yellow is further reflected by a second mirror 55*b* and a third mirror 55*c* and directed onto the surface of the photoreceptor 11Y. The laser light for magenta is reflected by a first mirror 56*a* to the long lens 59M after passing through a double-layered f-theta lens 54*a*, and thus optical face tangle error of the polygon mirrors 51 and 52 are corrected. The laser light for magenta is further reflected by a second mirror 56*b* and a third mirror 56*c* and directed onto the surface of the photoreceptor 11M.

By contrast, the laser lights for cyan and black pass through a double-layered f-theta lens 54*b* after being reflected by the rotary polygon mirrors 51 and 52. Then, the laser lights for cyan is reflected by a first mirror 57*a* to the long lens 59C so as to correct optical face tangle error of the polygon mirrors 51 and 52 and directed onto the surface of the photoreceptor 11C by a second mirror 57*b* and a third mirror 57*c*.

The laser light for black that has passed through the double-layered f-theta lens 54*b* is reflected by a first mirror 58*a* to the long lens 59K, and thus optical face tangle error of the polygon mirrors 51 and 52 are corrected. The laser light for black is further reflected by a second mirror 58*b* and a third mirror 58*c* and directed onto the surface of the photoreceptor 11K.

The optical writing unit 50 includes adjusters for adjusting curvature and inclination of the laser lights (scanning lights). These adjusters are hereinafter referred to as scanning light inclination adjusters. The inclination of the laser lights is adjusted by changing the inclination of the long lens units 150Y, 150M, and 150C, respectively.

It is to be noted that the scanning light inclination adjusters are provided in the long lens units 150Y, 150M, and 150C that correspond to the photoreceptors 11Y, 11M, and 11C, respectively, because curvature and inclination of the scanning lights for yellow, magenta, and cyan are adjusted based on curvature and inclination of the scanning light for black.

Adjustment of curvature and inclination of the scanning lights is described below based on the long lens unit 150Y that corresponds to the photoreceptor 11Y. It is to be noted that, for simplification, the reference character indicating yellow is omitted in the description below.

Figure 4A:
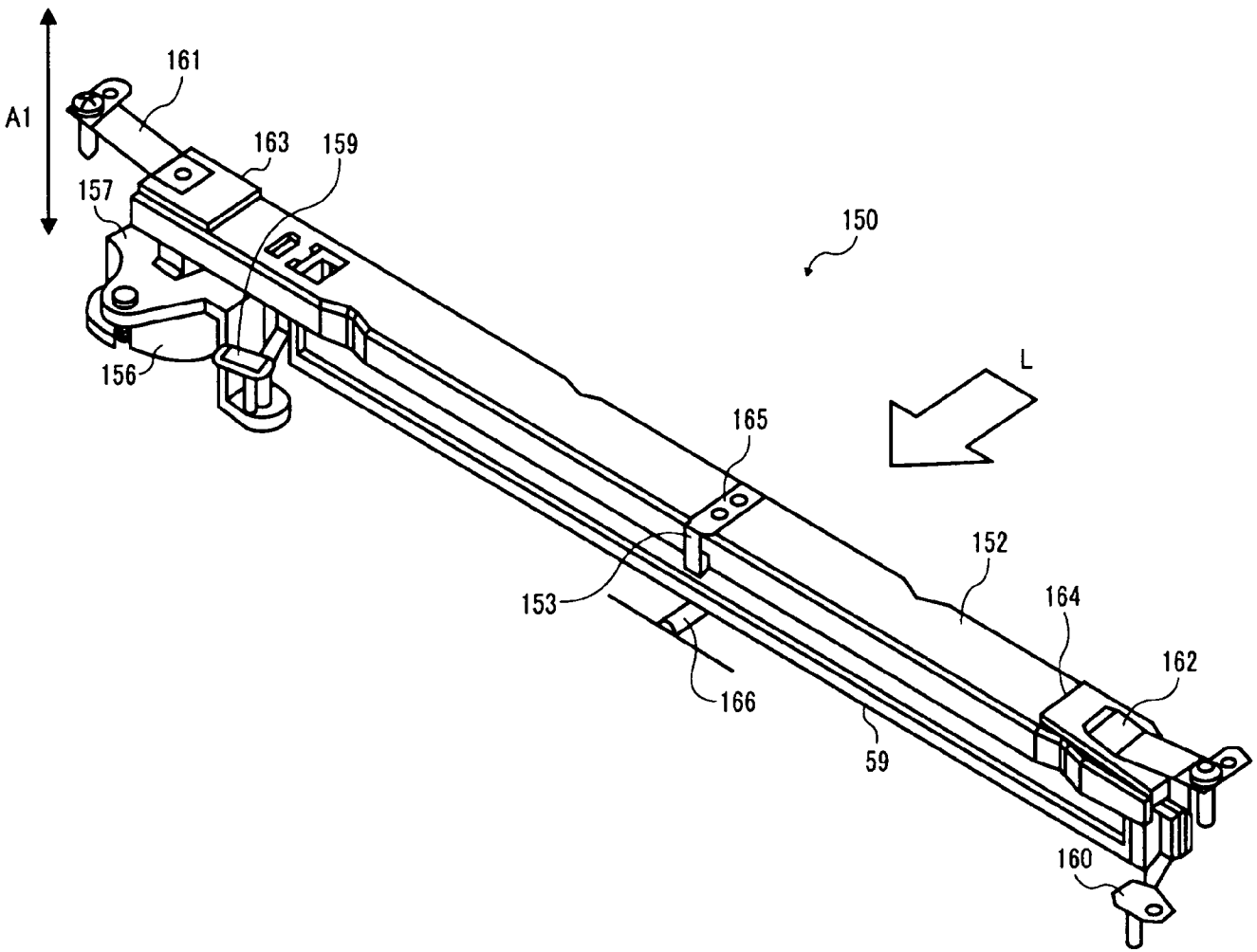
FIG. 4A is a perspective view of a long lens unit included in the optical writing unit shown in FIG. 3.
Figure 4B:
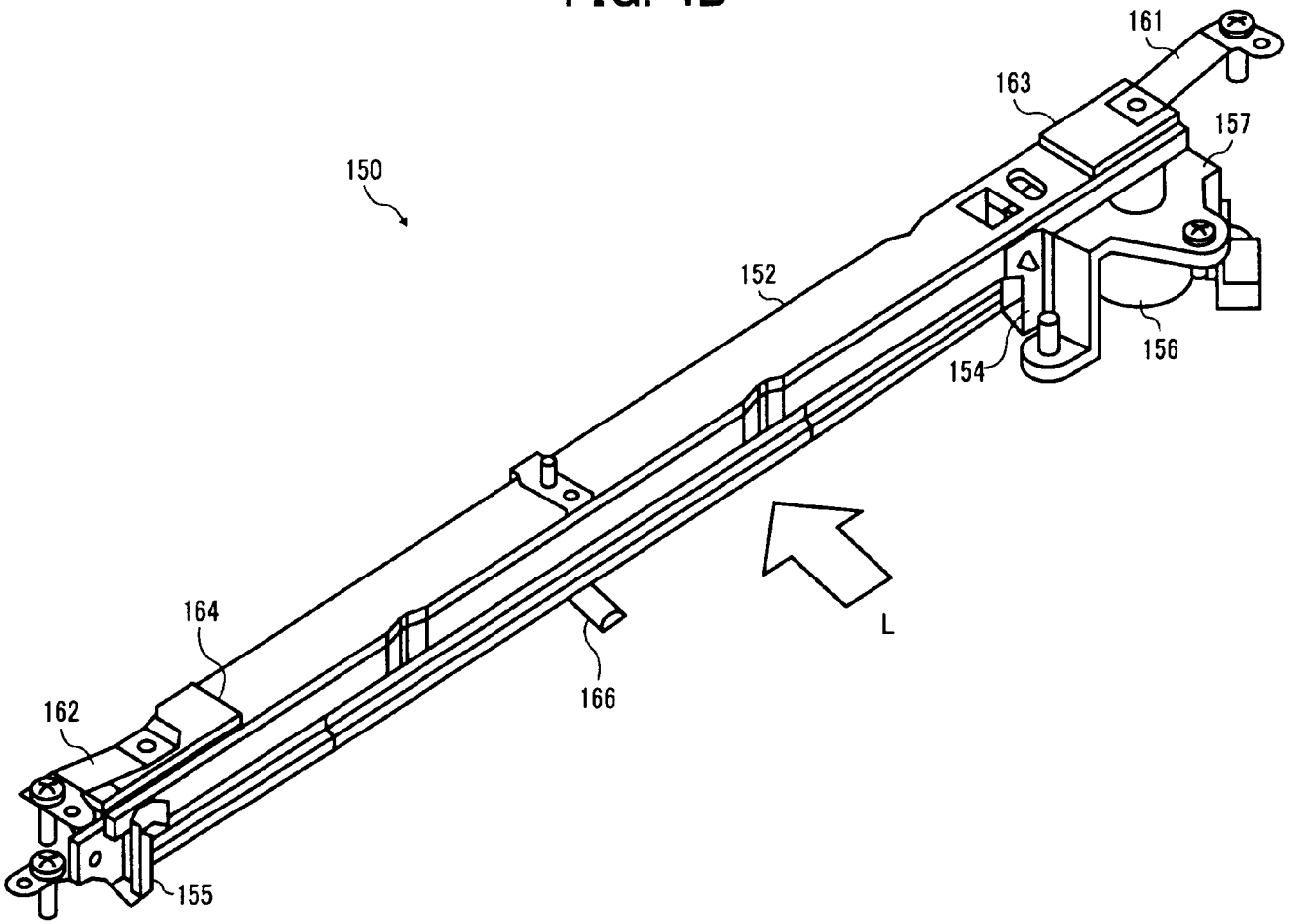
FIG. 4B is another perspective view of the long lens unit included in the optical writing unit shown in FIG. 3.

FIGS. 4A and 4B are perspective diagrams of the long lens unit 150.

In addition to the long lens 59 that corrects the face tangle error of the rotary polygon mirrors 51 and 52, the long lens unit 150 includes a bracket 152 holding the long lens 59, a flat spring 153 for adjusting curvature of the scanning light, flat springs 154 and 155 for fixing the long lens 59 and the bracket 152, and a driving motor 156 for adjusting inclination of the scanning light automatically. The long lens unit 150 further includes a driving motor mount 157, a housing fixer 159, flat springs 150, 161, and 162 for supporting the long lens unit 150, smooth surface members 163 and 164 that serve as friction coefficient reducers, a screw 165 for adjusting curvature of the scanning light, a support 166, and a screw receptor, not shown.

To adjust inclination of the scanning light, a rotation angle of the driving motor 156 is adjusted based on a skew calculated in positional error control processes to be described below. By adjusting the rotation angle of the driving motor 156, an vertical adjustment screw attached to a rotary axis of the driving motor 156 moves up and down, and thus an end portion of the long lens unit 150 in which the driving motor 156 is located moves in a direction indicated by arrow A1.

More specifically, when the vertical adjustment screw moves up, the end portion of the long lens unit 150 including the driving motor 156 ascends against a pressing force of the flat spring 161, and accordingly the long lens unit 150 pivots on the support 166 clockwise in FIG. 4A. By contrast, when the vertical adjustment screw moves down, the end portion of the long lens unit 150 including the driving motor 156 descends due to the pressing force of the flat spring 161, and accordingly the long lens unit 150 pivots on the support 166 counterclockwise in FIG. 4A.

When the inclination of the long lens unit 150 is changed as described above, an incident position of the laser light L on a light-receiving surface of the long lens 59 changes. The long lens 59 has a characteristic that a departure angle of the laser light L from a light output surface of the long lens 59 changes in a vertical direction when the incident position of the laser light L on a light receiving surface of the long lens 59 changes in a vertical direction that is perpendicular to both a longitudinal direction of the long lens unit 150 and an optical path. With this characteristic, when the inclination of the long lens unit 59 is changed by the vertical adjustment screw, the departure angle of the laser light L from the light output surface of the long lens 59 changes, and thus the inclination of the scanning light on the photoreceptor 11 is changed.

Figure 5:
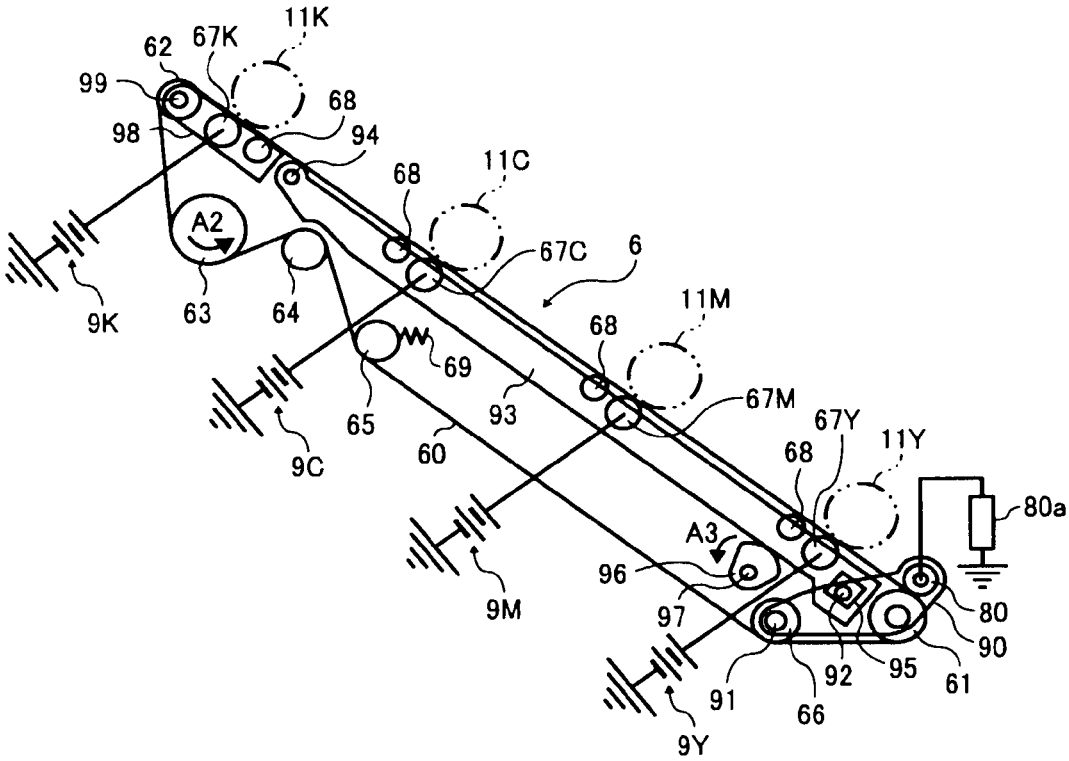
FIG. 5 is an enlarged illustration of a transfer unit included in the image forming apparatus shown in FIG. 1.

FIG. 5 is a schematic illustration of the transfer unit 6. In the present embodiment, the transfer belt 60 is an endless single-layered belt having a relatively high resistivity of within a range from $10^9$ Ωcm to $10^{11}$ Ωcm and includes polyvinylidene fluoride (PVDF).

The transfer unit 6 further includes an electrostatic absorption roller 80 that is located on the outer surface of the transport belt 60, facing the entrance roller 61 via the transport belt 60, and receives a predetermined or given voltage from a power source 80*a*. The transfer sheet 100 passes between the entrance roller 61 and the electrostatic absorption roller 80 and is then electrostatically attracted to the surface of the transfer belt 60. The driving roller 63 connects to a power source, not shown, and rotates in a direction indicated by arrow A2 to frictionally drive the transport belt 60. The transfer sheet 100 is transported by the transport belt 60 to a position where the exit roller 62 is located and then leaves the transport belt 60.

Each of the bias applicators 67Y, 67M, 67C, and 67K located at the transfer positions to face the photoreceptors 11Y, 11M, 11C, and 11K, respectively, is a bias roller, with an elastic layer including sponge, etc. formed on an outer surface thereof. Transfer biases are applied from bias power sources 9Y, 9M, 9C, and 9K to metal cores of the bias applicators 67Y, 67M, 67C, and 67K, respectively. By action of the transfer biases, transfer charges are given to the transport belt 60, and thus a transfer electrical field having a predetermined or given electrical field strength is formed at each transfer position located between the transport belt 60 and one of the photoreceptors 11Y, 11M, 11C, and 11K. Further, a backup roller 68 is provided close to each of the bias applicators 67Y, 67M, 67C, and 67K so as to maintain predetermined or desired contact between the transport belt 60 and one of the photoreceptors 11Y, 11M, 11C, and 11K in each region where image transfer is performed.

The transfer unit 6 further includes an entrance roller bracket 90 that is swingable around a shaft 91, a swing bracket 93 that is swingable around a rotary axis 94, a cam 96 attached to a cam shaft 97, an exit bracket 98, and an shaft 99.

The bias applicators 67Y, 67M, and 67C and three backup rollers 68 located close thereto, respectively, are integrally held by the swing bracket 93 and swingable around the rotary axis 94. When the cam 96 rotates in a direction indicated by arrow A3, the bias applicators 67Y, 67M, and 67C and three backup rollers 68 swing clockwise around the rotary axis 94 in FIG. 5.

The entrance roller 61 and the electrostatic absorption roller 80 are integrally held by the entrance roller bracket 90 and swingable clockwise around the shaft 91 in FIG. 5. The swing bracket 93 is provided with a hole 95 that engages a pin 92 attached to the entrance roller bracket 90, and thus the entrance roller 60 and the electrostatic absorption roller 80 swing in conjunction with the swing bracket 93.

With the clockwise rotation of the entrance roller bracket 90 and the swing bracket 93, the bias applicators 67Y, 67M, and 67C and three backup rollers 68 separate from the photoreceptors 11Y, 11M, and 11C, respectively, and the entrance roller 60 and the electrostatic absorption roller 80 move downward in FIG. 5. Thus, the transport belt 60 can separate from the photoreceptors 11Y, 11M, and 11C during a monochrome printing mode to form only black (monochrome) images.

As described above, a structure including the swing bracket 93, the cam 96, and the entrance roller bracket 90 moves an upstream portion of the transfer belt 60 in the sheet transport direction toward and away from the photoreceptors 11Y, 11M, and 11C.

By contrast, the bias applicator 67K and the backup roller 68 located close thereto are held by the exit bracket 98 and swingable around the shaft 99 that is identical to an axis of the exit roller 62. When the transfer unit 6 is installed to and removed from a main body of the image forming apparatus 300, the bias applicator 67K and the backup roller 68 located close thereto are swung clockwise by operating a handle, not shown, and moved away from the photoreceptor 11K.

The support roller 64 is located downstream of the driving roller 63 in a direction of movement of the transport belt 60 (sheet transport direction) and pushes the outer surface of the transport belt 60 inward so that the transport belt 60 adequately winds around the driving roller 63. Further, the tension roller 65 located downstream of the support roller 64 in the sheet transport direction gives a predetermined or given tension to the transport belt 60, being pressed by a biasing member 69, which may be a spring.

A description is now given of a process of forming an image with the image forming apparatus 300 of the present embodiment.

With reference to FIG. 1, the transfer sheet 100 is fed from one of the sheet cassettes 3 and 4 and the manual feed tray MF, and transported by transport rollers, not shown, to a stop position at which the pair of registration rollers 5 are located, while being guided by a transport guide, not shown. The registration rollers 5 forward the transfer sheet 100 so that the transfer sheet 100 passes through transfer nips formed in the transfer positions in synchronization with the toner images formed on the photoreceptors 11Y, 11M, 11C, and 11K, respectively, being carried by the transport belt 60.

In a full-color printing mode, the charging rollers 15Y, 15M, 15C, and 15K shown in FIG. 2 uniformly charge the surfaces of the photoreceptors 11Y, 11M, 11C, and 11K, respectively. Then, the optical writing unit 50 directs modulated and deflected laser lights L onto the surfaces of the photoreceptors 11Y, 11M, 11C, and 11K, and thus the electrostatic latent images are formed thereon, respectively. The developing units 20Y, 20M, 20C, and 20K develop the electrostatic latent images formed on the surfaces of the photoreceptors 11Y, 11M, 11C, and 11K, respectively, forming the toner images thereon.

Thus, one of the charging rollers 15Y, 15M, 15C, and 15K, the optical writing unit 50, and one of the developing units 20Y, 20M, 20C, and 20K serve as an image forming member in the present embodiment.

When the transfer sheet 100 overlays the toner images formed on the photoreceptors 11Y, 11M, 11C, and 11K at the transfer nips, respectively, the toner images are transferred onto the transfer sheet 100 by the combined effect of the transfer electrical fields and nip pressures and superimposed one on another on the transfer sheet 100 to form a full-color toner image on the transfer sheet 100.

After the toner images are transferred therefrom, the surfaces of the photoreceptors 11Y, 11M, 11C, and 11K are cleaned by the counter blades 13Y, 13M, 13C, and 13K and then discharged by the discharge lamps 14Y, 14M, 14C, and 14K, respectively, and thus prepared for subsequent image formation.

After the full-color toner image is formed thereon, the transfer sheet 100 is transported to the fixer 7 where the toner image is fixed thereon and further transported in one of the first discharge direction indicated by arrow B and the second discharge direction indicated by arrow C according to a rotation angle of the switch guide G. When the transfer sheet 100 is transported in the first discharge direction indicated by arrow B, the transfer sheet 100 is stacked on the discharge tray 8 with its image surface (first side) facing down. By contrast, the transfer sheet 100 transported in the second discharge direction indicated by arrow C is forwarded to one of a sheet processor for performing sorting, stapling, etc., and the registration rollers 5 through a switch back unit, not shown, for forming an image on the other side (second side) of the transfer sheet 100.

Further, in the present embodiment, an axial length of each of the transport belt 60, the photoreceptors 11Y, 11M, 11C, and 11K, etc., in a main scanning direction corresponds to a width of a maximum usable sheet width for the image forming apparatus 300. That is, the length of each of the transport belt 60, the photoreceptors 11Y, 11M, 11C, and 11K, etc., in the main scanning direction is identical or similar to the maximum sheet width usable in the image forming apparatus 300, which in the present embodiment is 297 mm.

Figure 6:
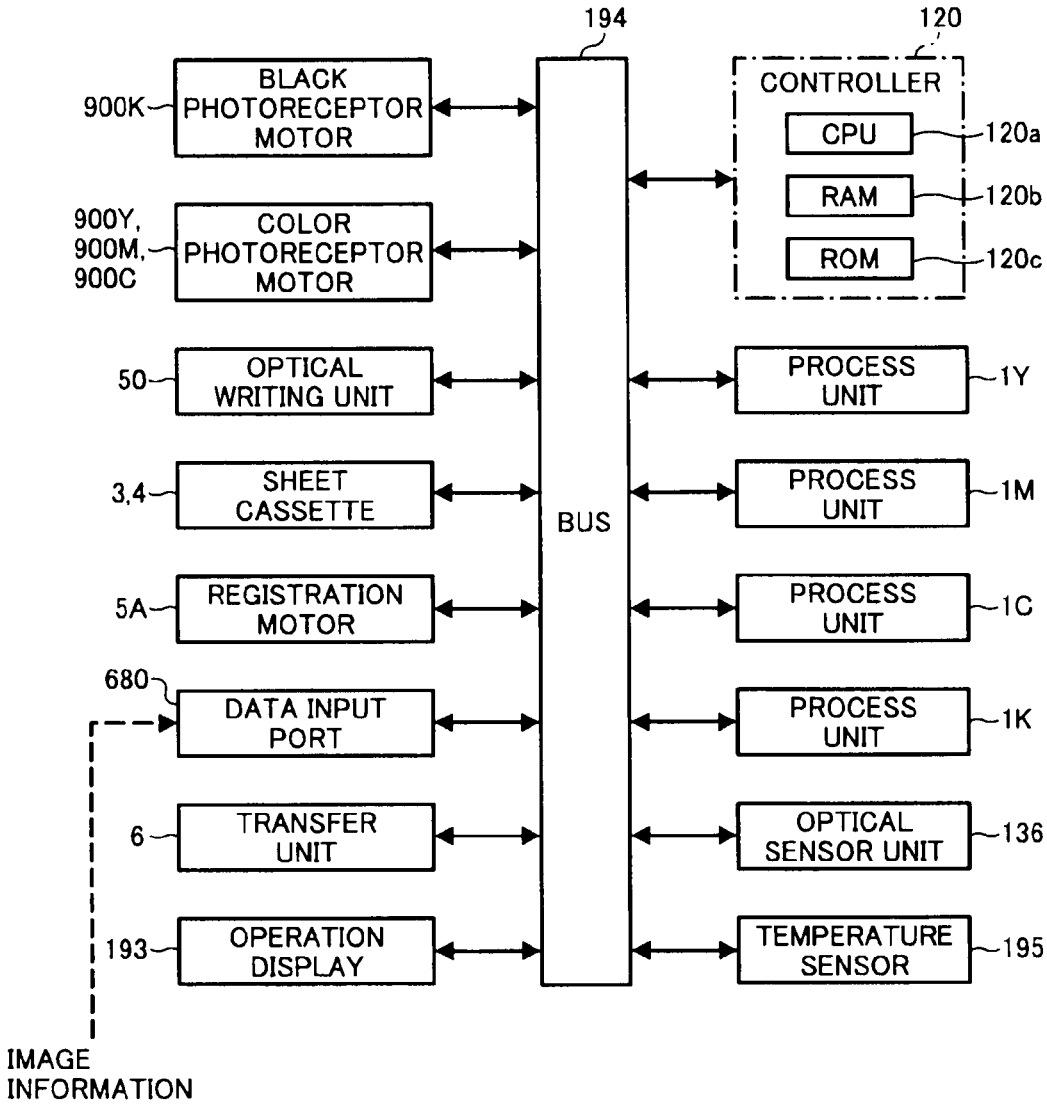
FIG. 6 is a block diagram illustrating a part of an electrical circuit of the image forming apparatus shown in FIG. 1.

FIG. 6 is a block diagram illustrating the main electrical circuitry of the image forming apparatus 300. As shown in FIG. 6, the electrical circuit of the image forming apparatus 300 includes a bus 194 that connects to a black photoreceptor motor 900K, color photoreceptor motors 900Y, 900M, and 900C, the optical writing unit 50, the sheet cassettes 3 and 4, a registration motor 5A, a data input port 680, the transfer unit 6, an operation display 193, a controller 120, the process units 1Y, 1M, 1C, and 1K, the optical sensor unit 136, and a temperature sensor 195 for detecting temperature inside the image forming apparatus 300 as an environmental condition.

It is to be noted that, although the temperature sensor 195 is provided as an environment detector in the present embodiment, alternatively, an environment detector for detecting humidity or both of temperature and humidity may be provided.

The black photoreceptor motor 900K rotationally drives the photoreceptor 11Y, and the color photoreceptor motors 900Y, 900M, and 900C rotationally drive the photoreceptors 11Y, 11M, and 11C, respectively. The registration motor 5A drives the registration rollers 5. The data input port 680 receives image information transmitted from computers, etc., not shown.

The controller 120 controls driving of respective parts of the image forming apparatus 300 and includes a central processing unit (CPU) 120*a*, a random access memory (RAM) 120*b*, and a read only memory (ROM) 120*c*. The controller 120 includes a function to count the number of transfer sheets 100 fed from the sheet cassettes 3 and 4, and from the manual feed tray MF. The operation display 193 includes multiple touch keys and a touch panel or a liquid crystal (LC) panel. The operation display 193 displays various information and transmit information input by users to the controller 120, being controlled by the controller 120. For example, the user can input size of the transfer sheets 100 contained in the sheet cassettes 3 and 4 shown in FIG. 1 or set on the manual feed tray MF shown in FIG. 1 via the operation display 193. Such sheet size information is transmitted to the controller 120 and stored in the RAM 120*a* or the ROM 120*b*.

The RAM 120*b* and the ROM 120*c* serve as storage units, and store data of test patterns serving as test toner images for detecting positional deviation and image densities of a solid image and a half-tone image. The RAM 120*b* of the controller 120 further stores target values VtrefY of the output voltage from the toner concentration sensor 26Y shown in FIG. 2. The RAM 120*b* also stores target values VtrefM, VtrefC, and VtrefK of output voltages from toner concentration sensors 26M, 26C, and 26K included in developing units 20M, 20C, and 20K, respectively.

Referring to FIGS. 2 and 6, toner supply control according to the present embodiment is described below.

The toner concentration sensor 26Y shown in FIG. 2 outputs a voltage corresponding to a magnetic permeability of the developer that passes above the toner concentration sensor 26Y. Because the magnetic permeability of the developer bears a certain relation to a toner concentration in the developer, a voltage value output by the toner concentration sensor 26Y corresponds to the toner concentration in the developer.

To control the supply of the yellow toner, the controller 120 shown in FIG. 6 compares the output voltage from the toner concentration sensor 26Y with the target value VrefY and drives the powder pump 27Y for a time period corresponding to a result of this comparison so as to supply the yellow toner to the second part 30Y of the developing unit 20Y.

By controlling the driving of the powder pump 27Y, that is, the supply of the yellow toner, as described above, a proper amount of the yellow toner is supplied to the second part 30Y after the yellow toner is consumed in image development and accordingly the concentration of the yellow toner decreases, and thus the concentration of the yellow toner in the developer to be supplied to the first part 29Y is kept within a predetermined or preferable range.

It is to be noted that, the toner supply in each of the developing units 20M, 20C, and 20K is controlled in a method similar to the method described above.

Figure 7:
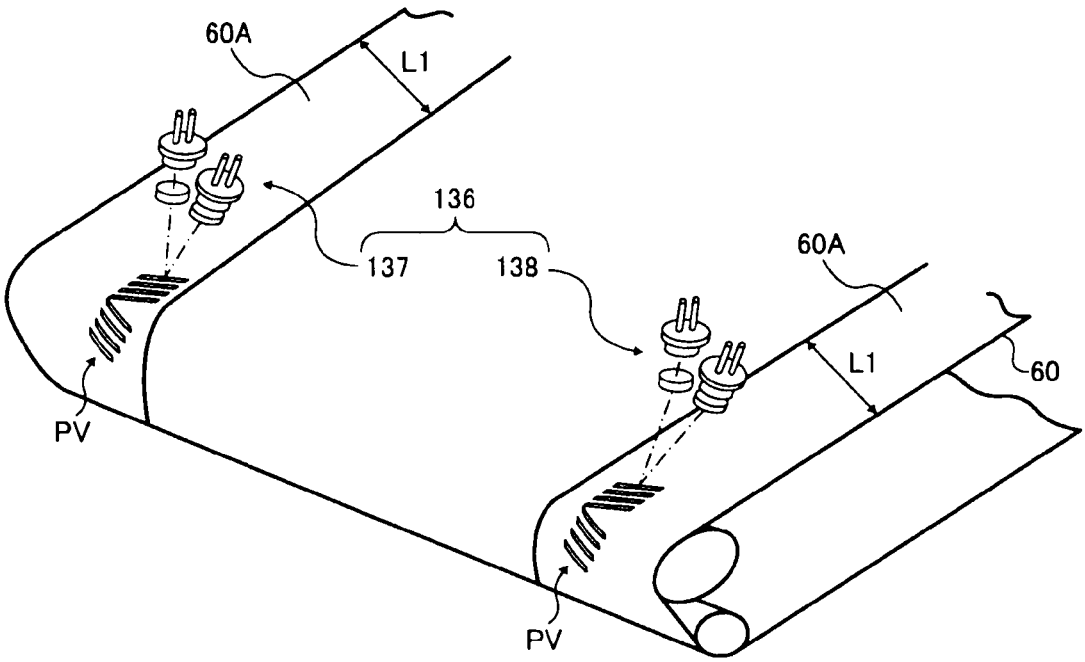
FIG. 7 illustrates a part of a transport belt and optical sensor unit included in the image forming apparatus shown in FIG. 1.

FIG. 7 is a perspective diagram illustrating a part of the transport belt 60 and the optical sensor unit 136.

As shown in FIG. 7, test pattern areas 60A are provided in both lateral margins or end portions of the transport belt 60 in a width direction (main scanning direction) as test toner image detection areas and have a width L1. The controller 120 shown in FIG. 6 controls the image forming members to form the test patterns (toner patches) to be used in the detections described above in these test pattern areas. The optical sensor unit 136 is provided above the transport belt 60 in FIG. 7 and includes a first optical sensor 137 and a second optical sensor 138.

The first optical sensor 137 passes a light emitted from a light emitter through a collecting lens onto the surface of the transport belt 60 and receives a reflection light with a light receiver. The first optical sensor 137 outputs a voltage as a detection signal according to an amount of the light received by the light receiver. The amount of the light received by the light receiver of the first optical sensor 137 significantly changes when the test pattern (toner patches) formed in one of the test pattern areas 60A passes below the first optical sensor 137, and thus the first optical sensor 137 detects the test pattern and changes the voltage output from the light receiver significantly.

Similarly, the second optical sensor 138 detects the test pattern formed in the other test pattern area 60A of the transport belt 60.

As described above, the optical sensor unit 136 including the first optical sensor 137 and the second optical sensor 138 serves as the toner image detector.

It is to be noted that an example of the light emitter is a light-emitting diode (LED) that can generate an adequate amount of reflection light for detecting the test pattern, and an example of the light receiver is a charge-coupled device (CCD) in which multiple light receiving elements are arrayed in line.

Figure 8:
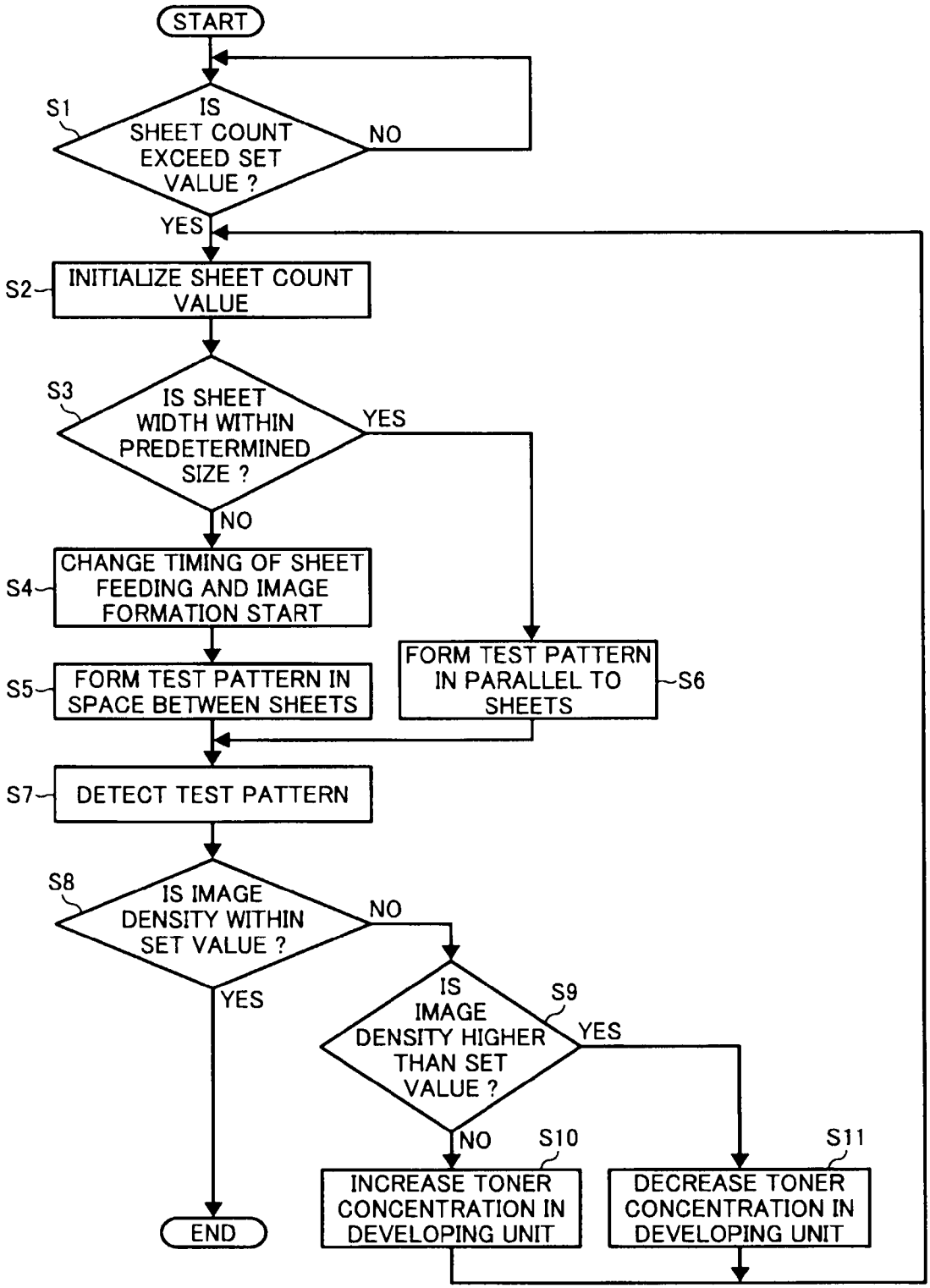
FIG. 8 illustrates a flow of adjustment of a solid image density.
Figure 9:
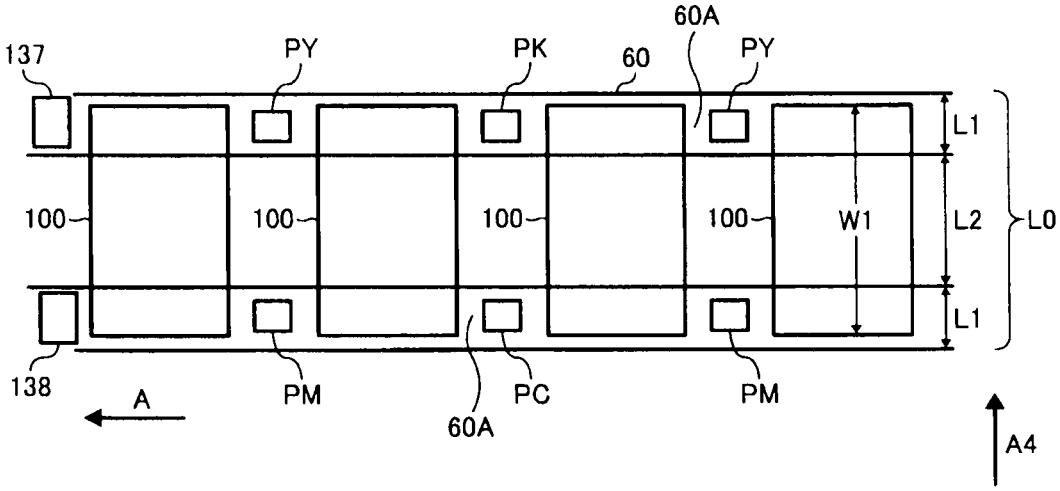
FIG. 9 illustrates a test pattern for detecting the solid image density when transfer sheets have a maximum width.
Figure 10:
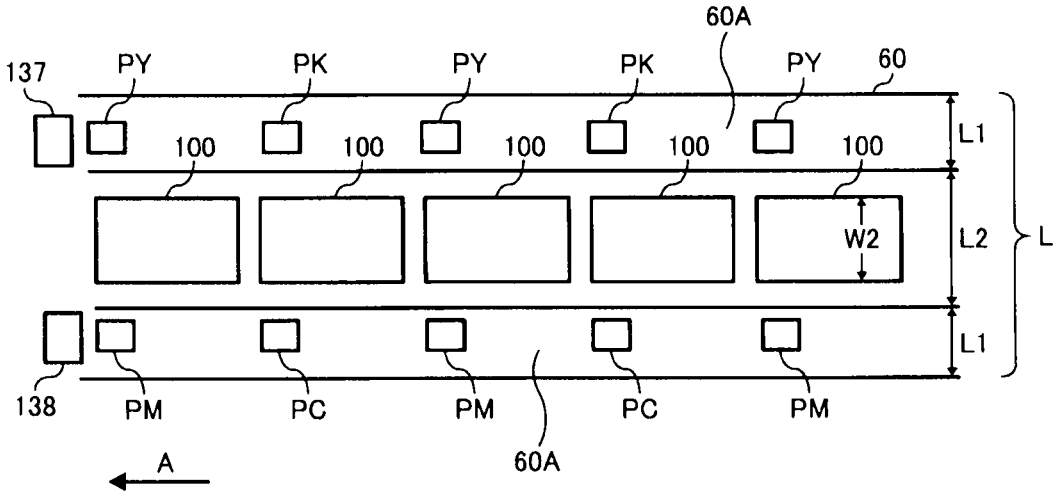
FIG. 10 illustrates a test pattern for detecting the solid image density when transfer sheets have a smaller width.

FIG. 8 illustrates a flow of adjustment of a density of a solid image (solid image density) according to the present embodiment. FIGS. 9 and 10 show examples of the test patterns including toner patches PY, PM, PC, and PK for yellow, magenta, cyan, and black, respectively, that are used to detect the solid image density.

In FIGS. 9 and 10, reference character L0 indicates a width of the transport belt 60, and L2 indicates a predetermined width that is obtained by deducting widths L1 of both the test pattern areas 60A from the width L0 of the transport belt 60 (L2=L0−2L1). In FIG. 9, the test pattern is formed between the transfer sheets 100 having a width W1 that is a length in the main scanning direction indicated by arrow A4 in the test pattern areas 60A, and in FIG. 10, the test pattern is formed parallel to the transfer sheets 100 having a width W2 in the test pattern areas 60A.

With reference to FIGS. 8 through 10, the adjustment of the solid image density during continuous image formation is described below.

During continuous image formation, the controller 120 shown in FIG. 6 counts the number of the transfer sheets 100 each time one transfer sheet 100 is fed from one of the sheet cassettes 3 and 4 and the manual feed tray MF shown in FIG. 1. At S1, the controller 120 checks whether or not the count of the transfer sheets 100 exceeds a set value stored in the RAM 120*b* or the ROM 120*c*. When that count does not exceed the set value (NO at S1), the controller 120 controls the image forming member to perform normal image formation.

By contrast, when the count of the transfer sheets 100 exceeds the set value (YES at S1), the controller 120 adjusts the solid image density. At S2, the controller 120 initializes the count of the transfer sheets 100, and at S3 checks whether or not a width of the transfer sheet 100 is within the predetermined width L2 shown in FIG. 9.

As shown in FIG. 9, when the width W1 of the transfer sheet 100 exceeds the predetermined width L2 (NO at S3), at S4 the controller 120 changes timings with which the transfer sheets 100 are fed and image formation starts so as to expand the space between the transfer sheets 100. It is to be noted that the predetermined width L2 is 220 mm in the present embodiment.

At S5, the controller 120 reads out the data of the test pattern for detecting the solid image density from the RAM 120*b* or the ROM 120*c* shown in FIG. 6 and controls the image forming member to form the test pattern (toner patches) in the spaces between the transfer sheets 100 as shown in FIG. 9.

It is to be noted that, although the toner patches PY and PM are formed in a first space, and the toner patches PK and PC in a second space between the transfer sheets 100 as the test pattern for detecting the solid image density in FIG. 9, the test pattern is not limited thereto. Thus, for example, the toner patches PY, PM, PC, and PK may be formed in the first space between the transfer sheets 100. Because the transfer sheet 100 partly covers the test pattern areas 60A when the width W1 thereof is larger than the predetermined width L2 as shown in FIG. 9, the test pattern is formed in the space between the transfer sheets 100.

By contrast, as shown in FIG. 10, when the width W2 of the transfer sheet 100 is within the predetermined width L2 (YES at S3), the test pattern can be formed parallel to the images to be transferred onto the transfer sheets 100 in the main scanning direction shown because the transfer sheets 100 do not cover the test pattern areas 60A. Thus, at S6 the controller 120 controls the image forming member to form the test pattern parallel to the images to be transferred onto the transfer sheets 100 in the main scanning direction when the width of the transfer sheet 100 is within the predetermined width L2.

It is to be noted that, although the toner patches PY and PM are formed parallel to an image to be transferred onto a first transfer sheet 100, and the toner patches PK and PC parallel to an image to be transferred onto a second transfer sheet 100 in the main scanning direction in FIG. 10, arrangement of the toner patches is not limited thereto. Thus, for example, the toner patches PY, PM, PC, and PK may be formed parallel to the image to be transferred onto the first transfer sheet 100.

The test pattern thus formed in the spaces between the transfer sheets 100 at S5 or parallel to the transfer sheets 100 at S6 is transported by the transfer belt 60 to a position facing the optical sensor unit 136, and at S7 the optical sensors 137 and 138 detect the test pattern and generate detection signals. These detection signals are converted into digital signals by an analog-to-digital converter, not shown.

At S8, based on the results of the image density detection indicated by the digital signals, the controller 120 determines whether or not the image density of each of the toner patches (solid image) PY, PM, PC, and PK is within a predetermined or preferable range. When the image densities of the respective color toner patches are within the predetermined range (YES at S8), the adjustment of the solid image density is completed.

By contrast, when the image density of one or more of these toner patches is out of the predetermined range, the controller 120 changes the target value Vtref for the output voltage from the toner concentration sensor 26 included in the developing unit 20 corresponding to the color of the toner patch whose image density is out of the predetermined range.

More specifically, at S9 the controller 120 determines whether or not the image density is higher than the predetermined range. When the results of the detection indicate that the image density is higher than the predetermined range (YES at S9), the controller 120 changes the target value Vtref for that color so as to decrease the toner concentration in the developing unit 20 for that color. By contrast, when the image density is lower than the predetermined range (NO at S9), the controller 120 changes the target value Vtref for that color so as to increase the toner concentration in the developing unit 20 for that color.

After the target value Vtref regarding that color is thus changed, the controller 120 performs the processes S2 through S11 again regarding that color. Alternatively, the adjustment of the image density may be completed without performing these processes S2 through S11 after the target value Vtref is changed.

It is to be noted that the number of the transfer sheets 100 as an interval of the adjustment of the solid image density can be set to one, and the solid image density can be adjusted continuously during the continuous image formation.

As described above, in the adjustment of the solid image density according to the present embodiment, when the width of the transfer sheet 100 is relatively small and the transfer sheet 100 does not cover the test pattern area 60A provided on both end portion of the transport belt 60 in the main scanning direction, the test pattern is formed parallel to the images to be transferred onto the transfer sheets 100 in the main scanning direction. Therefore, the adjustment of the solid image density can be performed without expanding the spaces between the transfer sheets 100, and thus productivity is not reduced.

Further, in the present embodiment, to keep the image forming apparatus compact and reduce its cost, the lengths of the transport belt 60, the photoreceptors 11Y, 11M, 11C, and 11K, etc., in the axial direction (main scanning direction) correspond to the maximum sheet width usable in the image forming apparatus 300. Therefore, when sheets having a width close to the maximum sheet width are used and the sheets therefore partly cover the test pattern areas formed in the end portions of the transport belt 60 in the main scanning direction, the spaces between sheets are expanded so that the test pattern can be formed in those spaces.

Thus, in the present embodiment, when the adjustment of the solid image density is performed during continuous image formation using relatively small sheets in the image forming apparatus including the transport belt, the photoreceptors, etc., having a length in the main scanning direction corresponding to the maximum sheet width, decrease in productivity can be minimized by changing the timing with which the test pattern for detecting the solid image density is formed (timing with which the transfer sheets are fed and the image formation starts).

Figure 11:
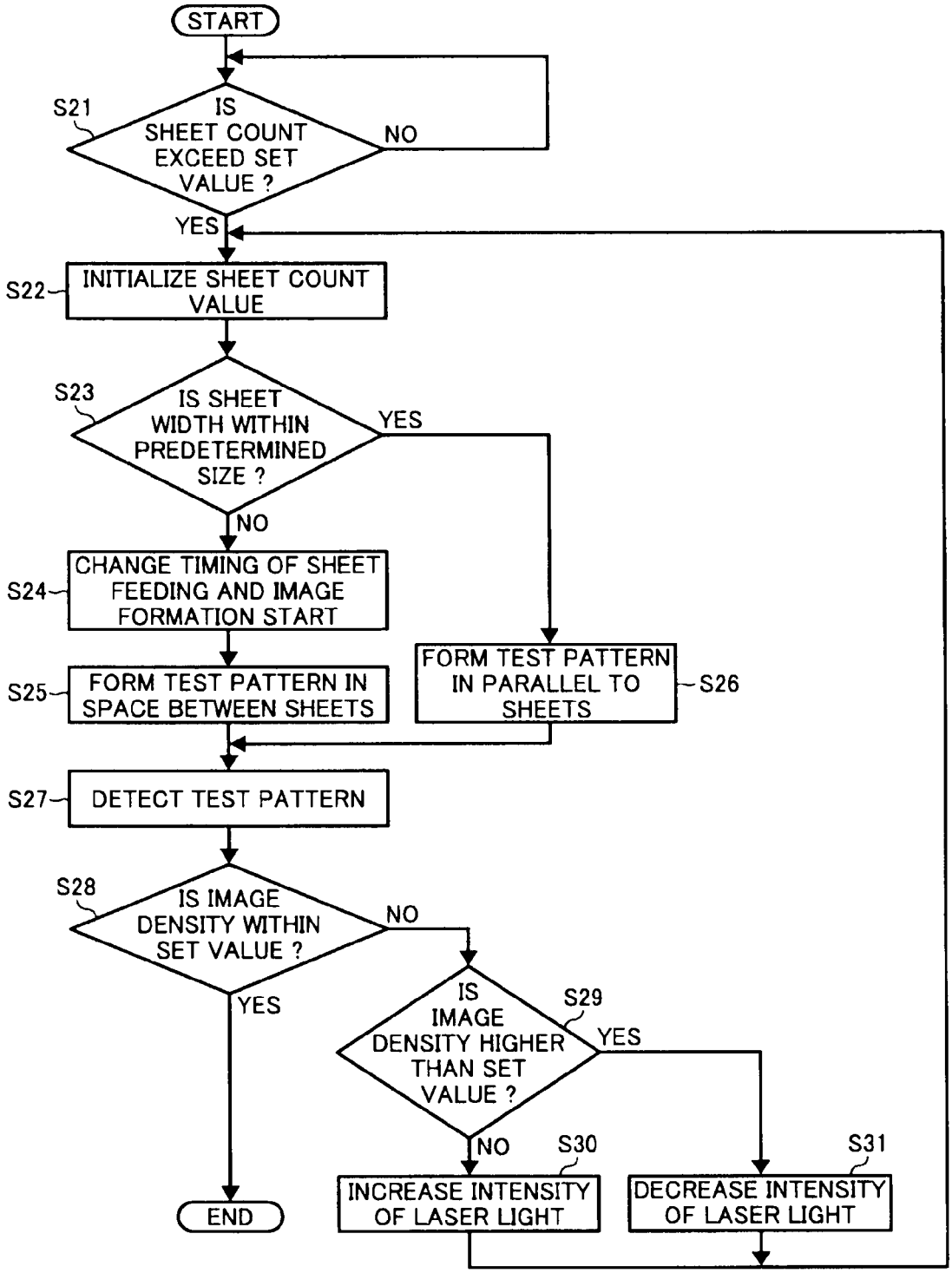
FIG. 11 illustrates a flow of adjustment of a half-tone image density.
Figure 12:
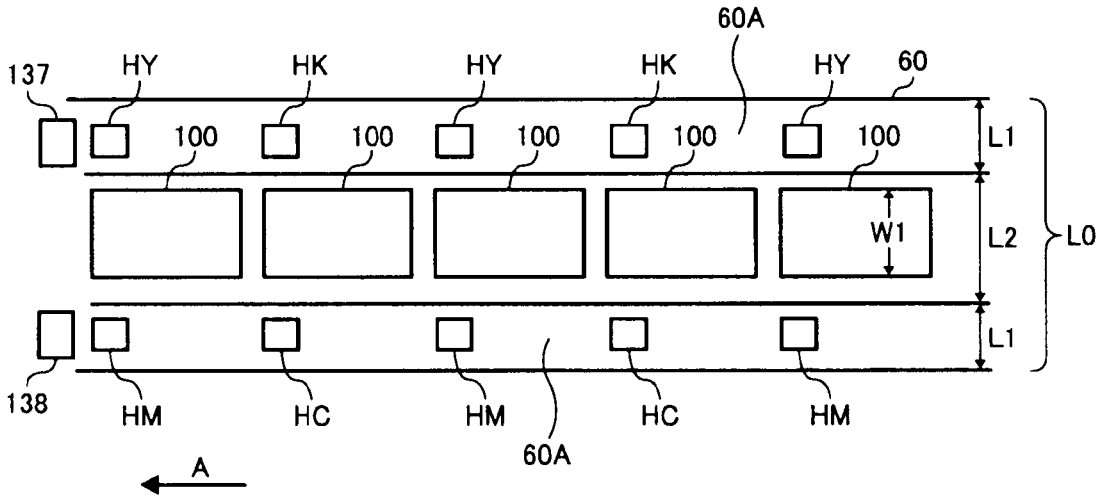
FIG. 12 illustrates a test pattern for detecting the half-tone image density when transfer sheets have a smaller width.

FIG. 11 is a flow of adjustment of a density of a half-tone image (half-tone image density), and FIG. 12 shows an example of the test pattern including toner patches HY, HM, HC, and HK for detecting the half-tone image density.

With reference to FIGS. 11 and 12, the adjustment of the half-tone image density is described below.

In this adjustment of the half-tone image density, the controller 120 performs processes S21 through S23 that are similar to processes S1 through S3 shown in FIG. 8, and thus descriptions thereof omitted.

When a width W1 of the transfer sheet 100 in the main scanning direction is smaller than the predetermined width L2, which is 220 mm in the present embodiment, as shown in FIG. 12 (YES at S23), the half-tone toner patches HY, HM, HC, and HK are formed in the test pattern areas 60A parallel to images to be transferred onto the transfer sheets 100 at S26. The toner patches HY, HM, HC, and HK are for yellow, magenta, cyan, and black, respectively, and have an image area ratio of 25%.

It is to be noted that, alternatively, all the toner patches PY, PM, PC, and PK may be formed parallel to one image to be transferred onto the first transfer sheet 100. In other words, the test pattern is not limited to the test pattern shown in FIG. 12 in which each of the toner patches PY, PM, PC, and PK is parallel to one of the images to be transferred onto the transfer sheets 100.

By contrast, when the width of the transfer sheets 100 in the main scanning direction is larger than the predetermined width L2 (NO at S23), at S24 the controller 120 changes the timing with which the transfer sheets 100 are fed and image formation starts so as to expand the space between the transfer sheets 100. At S25, the controller 120 controls the image forming member to form the half-tone toner patches in the now-expanded spaces between the transfer sheets 100.

At S27 the optical sensor unit 136 detects the test pattern and generate detection signals, and at S28 the controller 120 determines whether or not the image density of each of the toner patches (half-tone image) HY, HM, HC, and HK is within a predetermined or preferable range based on results of the detection. When the image densities of the respective color toner patches are within the predetermined range (YES at S28), the adjustment of the half-tone image density is completed.

By contrast, when the image density of one or more of the respective colors is out of the predetermined range, at S29 the controller 120 determines whether or not the image density of that color is higher than the predetermined range.

When the image density of that color is lower than the predetermined range (NO at S29), at S30 the controller 120 controls the optical writing unit 50 shown in FIG. 3 to increase intensity of the laser light regarding that color emitted from the laser light source (laser diode), and thus a writing density is increased. By contrast, when the image density of that color is higher than the predetermined range (YES at S29), at S31 the controller 120 controls the optical writing unit 50 to decrease intensity of the laser light regarding that color emitted from the laser light source, and thus the writing density is decreased.

It is to be noted that setting of the writing density is changed while the optical writing unit 50 is not directing the writing lights onto the photoreceptor 11.

After the setting of the writing density is thus changed, the controller 120 performs the processes S22 through S31 again. Alternatively, the adjustment of the half-tone image density may be completed without performing the processes S22 through S31 after the setting of the writing density is changed.

It is to be noted that the number of the transfer sheets 100 as an interval of the adjustment of the half-tone image density can be set to one so as to adjust the half-tone image density continuously during the continuous image formation. Further, it is to be noted that the half-tone image density can be adjusted by changing a writing time per dot.

As described above, in the present embodiment, when the lengths of the transport belt, the photoreceptors, etc., in the main scanning direction correspond to the width of the maximum sheet and the adjustment of the half-tone image density is performed during continuous image formation using relatively small sheets, decrease in productivity can be minimized by changing the timing with which the test pattern for detecting the half-tone image density is formed (timings with which the transfer sheets are fed and the image formation starts), similarly to the adjustment of the solid image density.

Figure 13:
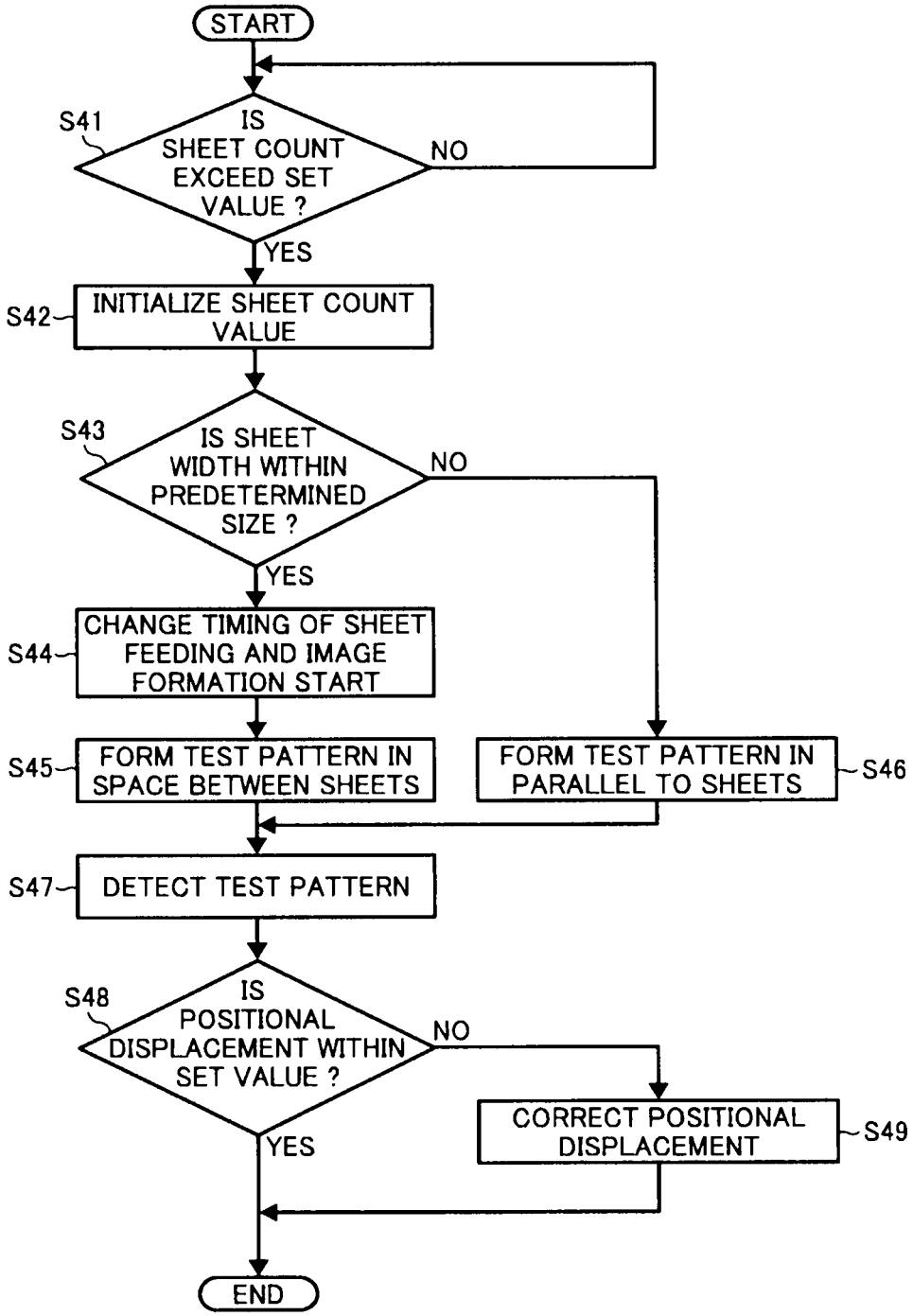
FIG. 13 illustrates a flow of adjustment of positional deviation.
Figure 14:
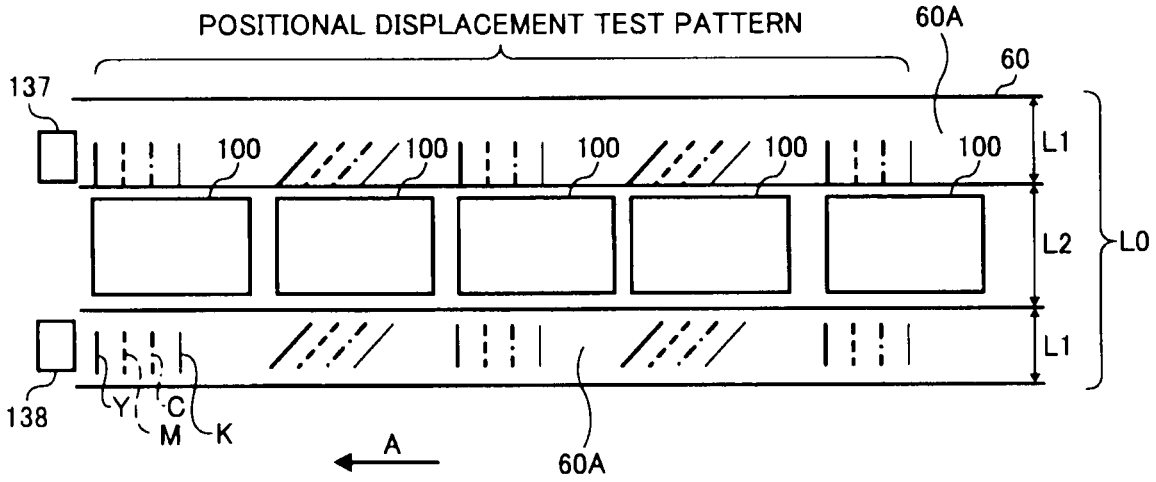
FIG. 14 illustrates a test pattern for detecting the positional deviation when transfer sheets have a smaller width.

FIG. 13 shows a flow of the adjustment of the positional deviation, and FIG. 14 shows an example of the test pattern for detecting the positional deviation.

Adjustment of the positional deviation during continuous image formation is described below with reference to FIGS. 13 and 14.

Similarly to the processes S1 through S3 shown in FIG. 8, the controller 120 shown in FIG. 6 counts the number of the transfer sheets 100 during continuous image formation, initializes the count of the transfer sheets 100 at S42 when this count exceeds a set value (YES at 41), and checks a width of the transfer sheets 100 on which images are formed at S43.

When the width of the transfer sheets 100 is smaller than the predetermined width L2, which is 220 mm in the present embodiment, as shown in FIG. 14 (YES at S43), at S46 the controller 120 controls the image forming member to form the test pattern for detecting the positional deviation in the test pattern areas 60A parallel to images to be transferred onto the transfer sheets 100.

By contrast, the width of the transfer sheets 100 is larger than the predetermined width L2 (NO at S43), at S44 the controller 120 changes the timing with which the transfer sheets 100 are fed and image formation starts so as to expand the space between the transfer sheets 100. At S45, the controller 120 controls the image forming member to form the test pattern in the spaces between the transfer sheets 100.

At S47, the optical sensor unit 136 detects the test pattern, and the controller 120 calculates deviation amounts in skew, registration in the main scanning direction and sub-scanning direction, and magnification in the main scanning direction, etc., based of results of the detection. At S48, the controller 120 determines whether or not each of these deviations is within a predetermined or preferable range.

When one or more of these calculated deviations are out of the predetermined range (NO at S48), at S49 the controller 120 corrects such deviations. More specifically, the deviation in the skew is corrected by changing the inclination of the long lens 59 shown in FIGS. 4A and 4B based on the calculated skew amount.

The deviation in the registration in the main scanning direction is corrected by changing the timing with which the optical writing onto the photoreceptors 11 starts based the deviation amount.

The deviation in the magnification in the main scanning direction is corrected by changing a frequency of a pixel synchronization clock that assigns image information for each pixel in a main scanning line.

The deviation in the registration in the sub-scanning direction is corrected by adjusting, based on the deviation amount, the timing with which the optical writing onto the photoreceptors 11 starts for every other face of the rotary polygon mirrors 51 and 52, that is, for each scanning line pitch.

It is to be noted that, in these adjustments, parameters for yellow, cyan, and magenta are changed with reference to a parameter for black. Further, these positional deviations are adjusted while the optical writing unit 50 is not writing an electrostatic latent image on the photoreceptors 11.

As described above, in the present embodiment, when the lengths of the transport belt, the photoreceptors, etc., in the main scanning direction correspond to the maximum sheet width and the adjustment of the positional deviation is performed during continuous image formation using relatively small sheets, decrease in productivity can be minimized by changing the timing with which the test pattern for detecting the half-tone image density is formed (timings with which the transfer sheets are fed and the image formation starts), similarly to the adjustment of the image density.

It is to be noted that, although the solid image density, the half-tone image density, and the positional deviations are separately adjusted in the descriptions above, the timings with which these adjustments are performed is not limited to that described above. Alternatively, two or more of the solid image density, the half-tone image density, and the positional deviation may be adjusted simultaneously by using a test pattern for detecting two or more of the solid image density, the half-tone image density, and the positional deviation.

Further, it is to be noted that the transport belt 60 has a relatively high frictional coefficient when temperature inside the image forming apparatus rises and accordingly it is humid therein. In such conditions, adhesion of the cleaning blade of the cleaning unit 85 shown in FIG. 1 to the transport belt 60 increases, and an edge portion of the cleaning blade is likely to deform because it is pulled by the moving surface of the transport belt 60.

In particular, when the transfer sheets 100 are relatively small, the frictional coefficient of the transport belt 60 differs between a transfer area in which the transfer sheets 100 are carried and other areas (non-transfer areas), because the transfer area is dehumidified by the transfer sheets 100 and the non-transfer areas are not dehumidified. As a result, the edge portion of the cleaning blade is likely to deform.

Figure 15:
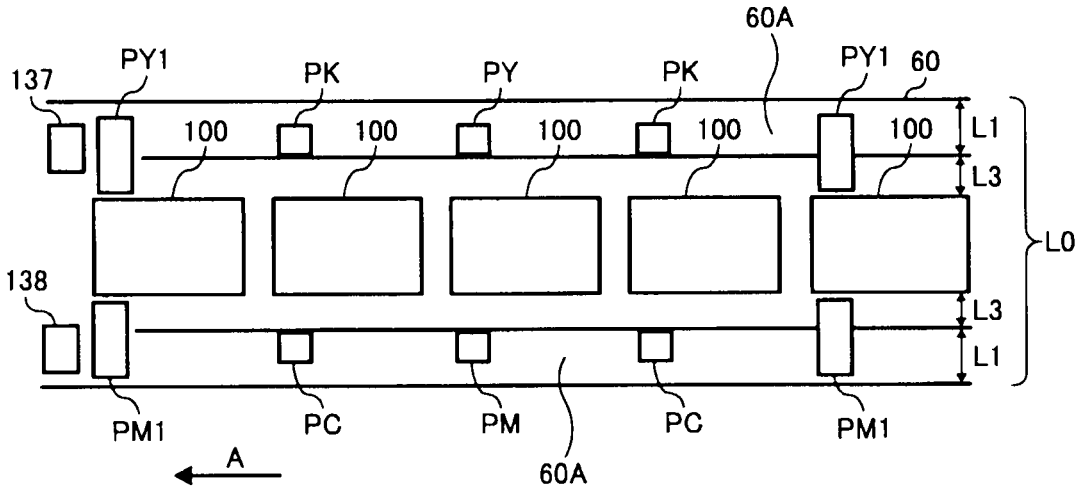
FIG. 15 illustrates a test pattern used when humidity inside the image forming apparatus shown in FIG. 1 is relatively high.

Therefore, another example of the test pattern, shown in FIG. 15, is used to prevent the cleaning blade of the cleaning unit 85 shown in FIG. 1 from deforming.

As shown in FIG. 15, when the transfer sheets 100 are relatively small, the transport belt 60 includes non-image areas in which neither images to be transferred onto the transfer sheets 100 nor the toner patches of the test pattern is formed. Each of non-image areas has a length L3 in the main scanning direction.

The test pattern shown in FIG. 15 includes toner patches PY, PY1, PK, PM, PM1, and PC, and one of these toner patches (PY1 and PM1) formed in each test pattern area 60A has a length in the main scanning direction longer that that of other toner patches so as to increase the amount of toner contacted by the cleaning blade.

More specifically, when the width of the transfer sheets 100 is smaller than the predetermined width L2 of the transport belt 60, the controller 120 shown in FIG. 6 calculates the length L3 of non-image areas. Then, one of the toner patches formed in each test pattern area 60A is expanded to the length L3 in the main scanning direction. Alternatively, because the transfer sheet 100 might be placed on the transport belt 60 in an erroneous position, one of the toner patches formed in each test pattern area 60 may be expanded to a length slightly shorter than the length L3 in the main scanning direction.

By increasing the amount of toner that the cleaning blade contacts as described above, an amount of toner sandwiched between the cleaning blade and the transport belt 60 is increased, and thus the adhesion therebetween is reduced and the deformation of the edge portion of the cleaning blade described above is prevented or reduced.

In the present embodiment, at least one of the toner patches formed in each test pattern area 60A is expanded in the main scanning direction when the temperature sensor 195 detects a temperature of 30° C. or higher, which is here considered a high temperature condition.

Although one of the toner patches formed in each test pattern area 60A is expanded in the main scanning direction in the example shown in FIG. 15, alternatively, all of those toner patches may be expanded in the main scanning direction. However, because a greater amount of toner is consumed when all of those toner patches are expanded in the main scanning direction, it is preferable that fewer toner patches are expanded in the main scanning direction so as to save toner.

It is to be noted that the humidity inside the image forming apparatus may be detected with a humidity sensor and at least one of the toner patches formed in each test pattern area 60A may be expanded in the main scanning direction when the humidity sensor detects a high humidity condition inside the image forming apparatus.

Further, it is to be noted that the adjustments described above can be applied in an intermediate transfer image forming apparatus.

Figure 16:
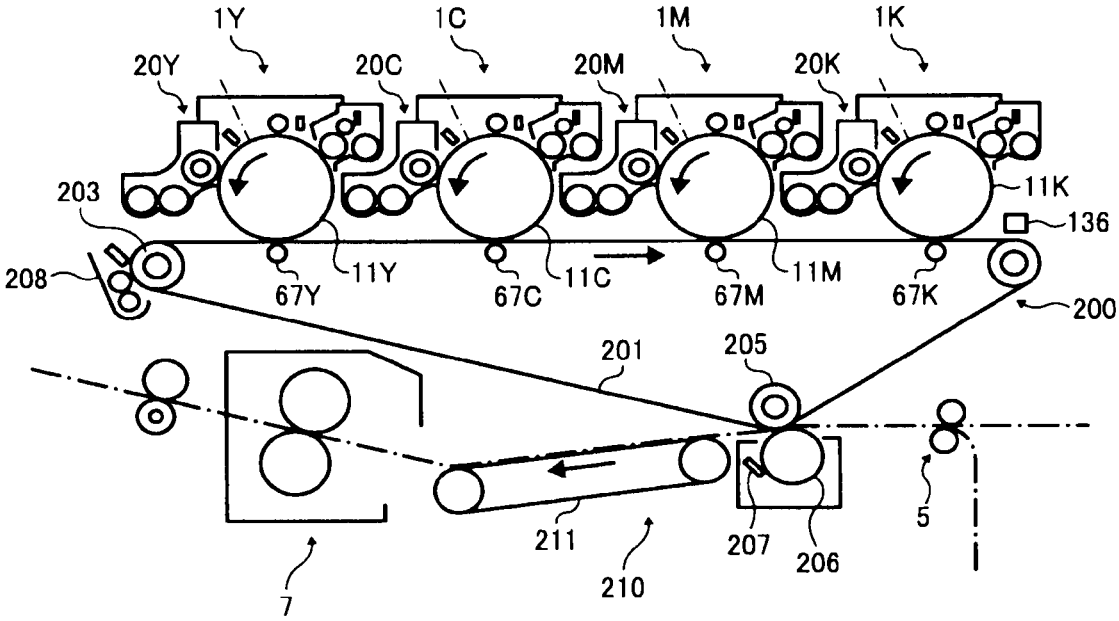
FIG. 16 illustrates a main part of a tandem image forming apparatus using an intermediate transfer method.

FIG. 16 shows a main part of a tandem image forming apparatus using an intermediate transfer method. This image forming apparatus includes process units 1Y, 1M, 1C, and 1K, an optical sensor unit 136, a pair of registration rollers 5, and a fixer 7, similarly to the image forming apparatus 300 shown in FIG. 1. This intermediate transfer image forming apparatus further includes a transfer unit 200 as a transferer and a transport unit 210 including a transport belt 211. The process units 1Y, 1M, 1C, and 1K includes photoreceptors 11Y, 11M, 11C, and 11K, and developing units 20Y, 20M, 20C, and 20K, respectively.

The transfer unit 200 includes an intermediate transfer belt 201, transfer bias applicators 67Y, 67M, 67C, and 67K serving as primary transferer, rollers 203 and 205, a secondary transfer roller 206 serving as a secondary transferer, a secondary transfer roller cleaner 207, and a belt cleaning unit 208.

The transfer bias applicators 67Y, 67M, 67C, and 67K transfer toner images from the photoreceptors 11Y, 11M, 11C, and 11K, respectively, and these toner images are superimposed one on another on the intermediate transfer belt 201 in a primary transfer process. Then, the secondary transfer roller 206 transfers the superimposed toner image from the intermediate transfer belt 201 onto a transfer sheet in a secondary transfer process. The transfer sheet carrying the toner image is transported by the transport belt 211 to the fixer 7 where the image is fixed on the transfer sheet 100.

In this intermediate transfer image forming apparatus, the optical sensor unit 136 faces the intermediate transfer belt 201. In such an intermediate transfer method, respective color toner images can be superimposed with higher positional accuracy than in a direct transfer method in which those toner images are superimposed on a transfer sheet.

Because the test pattern formed in a non-transfer area of the intermediate transfer belt 201 is transferred onto the secondary transfer roller 206, the secondary transfer roller cleaner 207 that is a cleaning blade as an example removes the test pattern from the secondary transfer roller 206.

It is to be noted that, when temperature inside the image forming apparatus is relatively high, the intermediate transfer belt 201 has a relatively high frictional coefficient similarly to the transport belt 60 shown in FIG. 5, and a cleaning blade of the belt cleaning unit 208 is likely to deform.

In particular, the non-image area of the intermediate transfer belt 201 is larger in the main scanning direction when relatively small transfer sheets are used. In such a case, an amount of toner remaining on the intermediate transfer belt 201 after the secondary transfer process, that is, an amount of toner removed by the cleaning blade differs in a center portion and an edge portion in the main scanning direction. That is, because a center portion of the cleaning blade in the main scanning direction contacts a relatively large amount of toner and such toner reduces adhesion thereof to the intermediate transfer belt 201, deformation of the center portion of the cleaning blade is prevented or reduced.

However, because a relatively small amount of toner remains on the edge portion of the intermediate transfer belt 201 and the edge portion of the cleaning blade contacts a relatively small amount of toner, the adhesion thereof to the intermediate transfer belt 201 is not reduced to a proper level, and thus the edge portion of the cleaning blade is likely to deform.

Therefore, a part of the test pattern formed on the intermediate transfer belt 201 is expanded in the main scanning direction when temperature inside the image forming apparatus is relatively high, similarly to that formed on the transport belt 60 shown in FIG. 5, so as to increase the amount of toner that the edge portion of the cleaning blade contacts.

Thus, the edge portion of the cleaning blade of the belt cleaning unit 208 contacts an adequate amount of toner, and the adhesion thereof to the intermediate transfer belt 201 is reduced so as to prevent or reduce the deformation of edge portion of the cleaning blade.

As described above, according to the illustrative embodiments of the present invention, when the length of the transfer sheet (recording medium) in the main scanning direction is shorter than the predetermined width L2, a toner image serving as the test pattern is not transferred onto the transfer sheet even when the test pattern is formed parallel to images to be transferred onto the transfer sheet in the main scanning direction, on the surface moving member that is the transfer belt or the intermediate transfer belt. The predetermined width L2 is obtained by deducting the length of the test pattern area from the length of the surface moving member in the main scanning direction. Therefore, when the length of the transfer sheet in the main scanning direction is shorter than the predetermined width L2, the test pattern is formed parallel to images to be transferred onto the transfer sheet in the main scanning direction, on the surface moving member, and thus decrease in productivity can be minimized even if the test pattern is detected during continuous image formation.

Therefore, a higher productivity can be maintained during continuous image formation compared to a case in which the test pattern is formed in spaces between the transfer sheets on the surface moving member regardless of the length of the transfer sheets in the main scanning direction.

By contrast, when the length of the transfer sheets in the main scanning direction is longer than the predetermined width L2, the test pattern is formed in spaces between the transfer sheets on the surface moving member. Therefore, the lengths of the photoreceptor and the surface moving member can be shorter in the main scanning direction compared to a case in which the test pattern is formed parallel to the transfer sheets on the surface moving member regardless of the length of the transfer sheet in the main scanning direction used in continuous image formation, and thus the image forming apparatus can be compact and the cost thereof can be reduced.

Further, because each of the photoreceptor that is an image carrier and the transport belt or the intermediate transfer belt that is a surface moving member has a length corresponding to the maximum sheet width usable in the image forming apparatus, the image forming apparatus can be compact and the cost thereof can be reduced.

Further, when the test pattern is for detecting the solid image density, decrease in productivity can be minimized when the solid image density is adjusted during continuous image formation using the transfer sheets having a length in the main scanning direction shorter than the predetermined width L2.

Similarly, when the test pattern is for detecting the half-tone image density, decrease in productivity can be minimized when the half-tone image density is adjusted during continuous image formation using the transfer sheets having a length in the main scanning direction shorter than the predetermined width L2.

Similarly, when the test pattern is for detecting the positional deviation, decrease in productivity can be minimized when the positional deviation is adjusted during continuous image formation using the transfer sheets having a length in the main scanning direction shorter than the predetermined width L2.

Further, because data for the test patterns for detecting the solid image density, the half-tone image density, and the positional deviation is stored in the RAM 120*b* or ROM 120*c* serving as the storage unit, the solid image density, the half-tone image density, and the positional deviation can be adjusted by forming the test pattern according to the data read out from the storage unit.

Further, the image forming apparatus according to the embodiment of the present invention includes an environment detector for detecting at least one of temperature and humidity inside the image forming apparatus, and the controller 120 shown in FIG. 6 changes the length of the toner image used as the test pattern in the main scanning direction based on a result generated by the environment detector. By changing the length of the toner image, the amount of toner contacted by the cleaning blade is increased. Therefore, even when temperature and humidity inside the image forming apparatus are relatively high and accordingly the surface moving member has a relatively high frictional coefficient, the adhesion of the cleaning blade to the surface moving member can be reduced and deformation of the cleaning blade can be prevented or reduced.

Further, in the intermediate transfer image forming apparatus, the secondary transfer roller cleaner is provided to clean the surface of the secondary transfer roller. Thus, the test pattern transferred onto the secondary transfer roller is removed, and toner does not adhere to a back side of the transfer sheet.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image carrier;

an image forming member configured to form a toner image on the image carrier;

a transferer located to face the image carrier, configured to transfer the toner image from the image carrier directly onto a recording medium transported by a surface moving member or onto the recording medium after transferring the toner image onto a surface of the surface moving member;

a toner image detector located adjacent to the surface moving member, configured to detect a test toner image formed in a test toner image detection area located at an end portion of the surface moving member;

an environment detector configured to detect at least one of a temperature and a humidity inside the image forming apparatus;

a cleaner contacting the surface moving member, configured to remove toner adhered to the surface moving member; and a controller configured to check a length of the recording medium in a main scanning direction during continuous image formation to form images on multiple recording media successively and control the image forming member to form the test toner image, wherein, when the length of the recording medium in a main scanning direction is longer than a value obtained by deducting two times a length of the test toner image detection area from a length of the surface moving member in the main scanning direction, the test toner image is formed in a space between the recording media, and, when the length of the recording medium in a main scanning direction is shorter than the value obtained by deducting two times the length of the test toner image detection area from the length of the surface moving member in the main scanning direction, the test toner image is formed parallel to toner images transferred onto the recording media, wherein the controller changes the test toner image based on a result generated by the environment detector, and wherein, when the environment detector detects one of a high temperature condition and a high humidity condition, the controller changes a length of the test toner image in the main scanning direction.

2. The image forming apparatus according to claim 1, wherein a length of the image carrier and the length of the surface moving member in the main scanning direction correspond to a maximum width of recording media usable in the image forming apparatus.

3. The image forming apparatus according to claim 1, wherein the test toner image is for detecting an image density of a solid image.

4. The image forming apparatus according to claim 1, wherein the test toner image is for detecting positional deviation.

5. The image forming apparatus according to claim 1, wherein the test toner image is for detecting an image density of a half-tone image.

6. The image forming apparatus according to claim 1, further comprising a storage unit storing data for at least test toner images for detecting image positional deviation and densities of a solid image and a half-tone image.

7. The image forming apparatus according to claim 1, further comprising:

a secondary transferer configured to transfer the toner image from the surface of the surface moving member onto the recording medium; and a cleaner configured to clean a surface of the secondary transferer.

8. The image forming apparatus according to claim 1, wherein:

the environment detector detects the temperature inside the image forming apparatus.

9. The image forming apparatus according to claim 1, wherein:

the environment detector detects the humidity inside the image forming apparatus.

10. A test toner image forming method used in an image forming apparatus, the image forming apparatus comprising:

an image carrier;

an image forming member configured to form a toner image on the image carrier;

a transferer located to face the image carrier, configured to transfer the toner image from the image carrier directly onto a recording medium transported by a surface moving member or onto the recording medium after transferring the toner image onto a surface of the surface moving member; and a toner image detector located adjacent to the surface moving member, configured to detect a test toner image formed in a test toner image detection area located at an end portion of the surface moving member, the test toner image forming method comprising:

checking a length of the recording medium in a main scanning direction during continuous image formation on multiple recording media successively;

forming the test toner image in the test toner image detection area after checking the length of the recording medium in the main scanning direction; and detecting at least one of a temperature and a humidity inside the image forming apparatus as an environmental condition, wherein, when the length of the recording medium in the main scanning direction is longer than a value obtained by deducting two times a length of the test toner image detection area from a length of the surface moving member in the main scanning direction, the test toner image is formed in a space between the recording media, and, when the length of the recording medium in a main scanning direction is shorter than the value obtained by deducting two times the length of the test toner image detection area from the length of the surface moving member in the main scanning direction, the test toner image is formed parallel to the toner image transferred onto the recording media, wherein the test toner image is changed based on a detected environmental condition, and wherein, when one of a high temperature condition and a high humidity condition is detected, a length of the test toner image in the main scanning direction is changed.

11. The test toner image forming method according to claim 10, further comprising:

calculating a length of a non-image area in the main scanning direction by deducting the length of the test toner image detection area and the length of the recording media from the length of the surface moving member in the main scanning direction, wherein, when one of a high temperature condition and a high humidity condition is detected, the test toner image is expanded in the main scanning direction for the length of the non-image area.

12. The test toner image forming method according to claim 10, wherein the detecting comprises:

detecting the temperature inside the image forming apparatus as the environmental condition.

13. The test toner image forming method according to claim 10 , wherein the detecting comprises:

detecting the humidity inside the image forming apparatus as the environmental condition.

* * * * *